United States Patent [19]

Kock et al.

[11] 4,167,245

[45] Sep. 11, 1979

[54] SPRAY DISPENSING

[75] Inventors: Ronald W. Kock; Theodore P. Merz; Paul K. Platt, all of Cincinnati, Ohio

[73] Assignee: The Procter & Gamble Company, Cincinnati, Ohio

[21] Appl. No.: 820,508

[22] Filed: Aug. 1, 1977

[51] Int. Cl.[2] ..... B05B 1/08

[52] U.S. Cl. ..... 239/11; 239/320; 239/329; 239/558; 222/391

[58] Field of Search ..... 239/101, 102, 320-322, 239/329, 558, 11; 222/340, 386, 391, 420, 565

[56] References Cited

U.S. PATENT DOCUMENTS

| | | | |
|---|---|---|---|
| 1,836,597 | 12/1931 | Horman | 222/262 |
| 2,085,446 | 6/1937 | Philippe | 222/386 |
| 2,259,857 | 10/1941 | Ostendorf | 221/47.3 |
| 2,346,879 | 4/1944 | Turzillo | 222/322 |
| 2,437,727 | 3/1948 | Drumheller | 124/27 |
| 2,628,743 | 2/1953 | Newlyn | 222/173 |
| 2,770,560 | 11/1956 | Hobson | 117/104 |
| 2,880,913 | 4/1959 | Peyron | 222/214 |
| 2,898,051 | 8/1959 | Teichert | 239/563 X |
| 3,162,337 | 12/1964 | Sabaka | 222/391 X |
| 3,163,360 | 12/1964 | McNinch, Jr. et al. | 239/124 |
| 3,219,279 | 11/1965 | Peeps | 239/583 |
| 3,495,826 | 2/1970 | Mizgala | 273/69 |
| 3,521,795 | 7/1970 | Langhjelm et al. | 222/386 |
| 3,601,988 | 8/1971 | Chermensky et al. | 60/54.5 HA |
| 3,626,446 | 12/1971 | Voltsekhovskaya | 60/54.5 HA |
| 3,756,460 | 9/1973 | Hill | 222/386 X |
| 3,782,380 | 1/1974 | Van der Gaast | 222/340 X |
| 4,065,034 | 12/1977 | Callan | 222/391 X |

*Primary Examiner*—Robert W. Saifer

*Attorney, Agent, or Firm*—John V. Gorman; Richard C. Witte; Thomas H. O'Flaherty

[57] ABSTRACT

Spray dispensing of a metered quantity of a preferably semi-liquid product from a filled container having a fixed wall provided with at least one and preferably a plurality of generally open and unobstructed discharge passageways. A moveable wall spaced apart from the fixed wall is impacted with a moving mass to induce a pressure pulse in the product sufficient to surge a metered quantity of product less than the entire content of the container through the generally open and unobstructed discharge passageways with sufficient velocity as to break away from the passageways and the remaining product within the container for ballistic travel generally normal the fixed wall outwardly of the container. A plurality of uniform discharge passageways and a proper match of product formulation and energy input produces a generally uniformly moving cluster of generally uniformly defined and moving particles. The cluster of particles may be aimed toward a target surface and the deposition pattern thereon may, by proper selection of energy and product, define a projection of the discharge passageway pattern selectively comprising either a discrete projection of the individual discharge passageways or a generally uniform coverage of the passageway locus set. A specific, preferred embodiment is as a non-contact dispenser of a stable, non-crusting, anhydrous, thixotropic antiperspirant cream, dispensed at a relatively low velocity so as to adhere to axilla surfaces with a minimum of rebound.

64 Claims, 39 Drawing Figures

SPRAY DISPENSING

FIELD OF THE INVENTION

This invention relates to spray dispensing and, more particularly, to spray dispensing of metered quantities of semi-liquid products finding particular utility for depositing a defined and metered pattern of, for example, an anhydrous cream antiperspirant product on an axilla surface.

BACKGROUND OF THE INVENTION

Spray dispensing is generally achieved by delivering a liquid product to a nozzle under pressure induced, e.g., by a pump, pressurized gas, or a collapsible wall container. Each of these dispensing systems have advantages and disadvantages that have made them more or less suitable for a wide variety of products. The thinner and less viscous the product, however, the easier it is to spray utilizing such pressure operated systems. The thicker and more viscous the product, conversely, the harder it is to spray utilizing such systems. Semi-liquid cream or like products, such as gels, thickened emulsions, and the like; products having high tackiness, tenaciousness or cohesiveness; or products having a very high solids content, are particularly difficult to spray through a nozzle utilizing conventional pump, pressurized gas, or collapsible wall dispensing systems.

Finger and trigger pumps as well as squeeze bottles, for example, are generally incapable of providing sufficient operating pressures for spraying thick cream-like products from nozzles and particularly for spraying products having a viscosity of 25 to 50 centipoise or higher. Gas operated systems are, of course, capable of supplying higher nozzle pressures but gas operated systems are prone to other problems, especially in inexpensive consumer product dispensing systems, including problems in providing clean start and stop action and a uniform metered spray especially with thick, cohesive products.

In spray product dispensing, whether in the industrial/commercial sector or in the consumer products sector, product safety is becoming increasingly recognized and even mandated as a prime requisite. Conversely economic/market pressures often require that such desirable increased safety be achieved without loss of convenience to the user and within a familiar product-package framework. Simultaneously, pressures exist to keep costs down, both in the immediate product costs to the consumer and in the overall environmental costs involved in providing and delivering the product.

In the area of anti-perspirant/deodorant products, for example, spray type products have been preferred by a large segment of the market, presumably in large part because of their "non-contact" mode of application; i.e., the product (as opposed to the package) is not susceptible to being touched by others prior to or between uses by a specific user as well as requiring only minimal user involvement with the target area.

Previous efforts to provide "non-contact" dispensing of products such as antiperspirant/deodorant products without fluorocarbon aerosols have generally involved attempted substitutions of other pressure sources for the dissolved pressurized aerosol gas, such as finger pumps, trigger pumps, squeeze bottles or substitution of other gas systems. Since these devices generally operate at lower pressures or lack long term uniformity of pressure, product formulations having decreased viscosities have generally been deemed necessary to permit successful spray application. Viscosity decreases, however, especially by use of increased solvent or volatile levels, whether aqueous or anhydrous, have generally not led to commercially satisfactory products, primarily because of increased problems of perceived wetness, coldness, runniness, and/or stickiness.

Similar problems of wetness, coldness and/or stickiness have been known to exist in non-spray antiperspirant products.

In the co-pending application Ser. No. 681,319 filed by David L. Shelton on Apr. 29, 1976 and assigned to The Procter & Gamble Company, now U.S. Pat. No. 4,083,956, issued Apr. 11, 1978 there are described certain highly stable anhydrous antiperspirant creams that are formulated with highly thixotropic cream vehicles containing particular concentrations of emollients and gelling agents which do not, in general, impart an undesirable, cold, wet or sticky sensation when applied to the skin, which exhibit minimal syneresis or bleeding of organic liquids from the thixotropic gel structure and which do not dry out or form unacceptable crusts upon prolonged exposure to the atmosphere. While the subject matter of the aforesaid Shelton application Ser. No. 681,319 was invented prior to the instant invention, the Shelton application did not contemplate the spray application of such a thickened cream product. The entire disclosure thereof, however, is hereby incorporated herein by reference as fully and completely as if physically reproduced hereat as exemplary of semi-liquid antiperspirant cream products which, in accordance with the methods and apparatus of the present invention we have discovered can be spray dispensed. However, it is also to be expressly understood that in its broader aspects our invention is not limited to spray dispensing of antiperspirant creams in general or as specifically described in the aforesaid Shelton application but is of general utility for spray dispensing of semi-liquid products as hereinelsewhere set forth.

In the antiperspirant field, however, the Shelton type formulations provide unique advantages when sprayed in accordance with the present methods and apparatus and form a unique combination therewith, enabling safe, convenient, aesthetically and environmentally satisfactory non-contact application of stable non-crusting antiperspirant products without wetness, coldness, stickiness or runnyness from a hand held and hand actuated dispenser.

OBJECTS OF THE INVENTION

Bearing in mind the foregoing, it is a primary object of the present invention to provide novel and improved methods of and apparatus for spray dispensing, particularly suitable for use with semi-liquid products.

Another primary object of the present invention, in addition to the foregoing object, is the provision of novel and improved methods of and apparatus for spray dispensing antiperspirant/deodorant products.

Another primary object of the present invention, in addition to each of the foregoing objects, is the provision of novel and improved methods of and apparatus for dispensing a metered quantity of product in a controlled and uniform ballistic cluster of closely defined particles, particularly suitable for semi-liquid products.

Still another primary object of the present invention, in addition to each of the foregoing objects is the provision of novel and improved methods of and apparatus for spray dispensing a metered quantity of an antiperspirant product in a controlled and uniform manner.

It is another primary object of the present invention, in addition to each of the foregoing objects, to provide novel and improved methods of and apparatus for packaging and dispensing a highly thixotropic, highly stable anhydrous antiperspirant cream.

It is yet another primary object of the present invention, in addition to each of the foregoing objects, to provide novel and improved methods and apparatus for spray dispensing such a highly thixotropic, highly stable anhydrous antiperspirant cream without, in general, imparting any undesirable, cold, wet, or sticky sensation when applied to the skin, and particularly the axilla surfaces.

It is still another primary object of the present invention, in addition to each of the foregoing objects, to provide novel and improved methods and apparatus for the "non-contact" delivery of antiperspirant and/or deodorant products without, in general, imparting any undesirable, cold, wet, sticky, or runny sensation to the skin and, particularly, axilla surfaces.

Yet another primary object of the present invention, in addition to each of the foregoing objects, is the provision of novel and improved methods of and apparatus for spray dispensing which is characterized by improved safety in providing generally uniform particle size, minimization of inhalables, and lack of any gaseous propellant.

Still another primary object of the present invention, in addition to each of the foregoing objects, is the provision of novel methods of and apparatus for spray dispensing a cluster of semi-liquid particles from a pattern of discharge orifices ballistically to a surface to impinge thereon with minimum penetration or rebound in a pattern generally reflecting a projection of the pattern of discharge orifices thereon.

Yet still another primary object of the present invention, in addition to each of the foregoing objects, is the provision of novel methods of and apparatus for spray dispensing a cluster of semi-liquid particles from a pattern of discharge orifices ballistically to a surface to impinge and merge thereon in a pattern generally reflecting a projection of the locus set of the pattern of discharge orifices.

Another and still further primary object of the present invention, in addition to each of the foregoing objects, is the provision of novel methods of and apparatus for spray dispensing metered quantities of a product from a container containing a static quantity of product in excess of the desired metered quantity, through at least one generally open and unobstructed discharge orifice without using valving or other closure of the discharge orifice to control the product discharge therethrough.

Still yet another primary object of the present invention, in addition to each of the foregoing objects, is the provision of novel methods of and apparatus for spray dispensing a cluster of cream antiperspirant particles to a surface to merge thereon into a generally uniform coating which does not feel cold or wet.

Yet another and still further primary object of the present invention, in addition to each of the foregoing objects, is the provision of a novel and improved combination of cream antiperspirant products and apparatus for spray dispensing thereof.

Yet another and yet still further primary object of the present invention, in addition to each of the foregoing objects, is the provision of novel and improved methods of and apparatus for spray dispensing a metered quantity of a preferably semi-liquid product, in a controlled and uniform manner from a filled container having a fixed wall provided with at least one and preferably a plurality of generally open and unobstructed discharge passageways and a moveable wall spaced apart from the fixed wall by impacting the moveable wall to induce a pressure pulse to the product having sufficient energy to surge a metered quantity of product less than the entire contents of the container through the discharge passageway with sufficient velocity as to break away from the passageway and the remaining product within the container for ballistic travel outward of the container as a cluster of generally uniformly defined and moving particles.

It is yet another primary object of the present invention, in addition to each of the foregoing objects, to provide such methods and apparatus wherein the paths of the particles of the cluster of dispensed particles may selectively be caused to be divergent, convergent, or parallel.

A yet still further primary object of the present invention, in addition to each of the foregoing objects, is the provision of a spray dispenser having an impact member that is accelerated to a desired velocity to effect expulsion of a product dose and a mechanism which combines triggering, cocking and release functions for an accelerating means within a single manual actuator or trigger.

A yet still further primary object of the present invention, in addition to each of the foregoing objects, is the provision of novel methods of and apparatus for spray dispensing independent of container orientation with the capacity of spraying in any direction and which is stable, safe, and predictably uniform independent of atmospheric pressures and compositions or gravitational forces, being capable of operation, for example, even in space or under water.

It is believed that it is a feature of the present invention that the impact does not generally advance the product mass within the container for expulsion through the discharge passageways. Rather, it is believed that the fixed wall generally retains the product mass from instantaneous movement so that the momentum of the impact mass produces primarily pressure head within the product mass which is recovered or converted to velocity head at the free surface of the product exposed through the discharge passageway. Hence, the direction of opening of the discharge passageways (i.e., their axes) need not be in line with the path of travel of the impact mass at the time of its impingement against the moveable wall or follower and the moveable and fixed walls need not be parallel. Discharge at right angles to the direction of impact is even possible. It also appears to be a necessary feature of the present invention that the total discharge passageway cross-sectional area be substantially smaller than the area of the moveable wall or follower.

The invention resides in the combination, construction, arrangement and disposition of the various component parts and elements incorporated in new and improved methods and apparatus for spray dispensing and in combinations of novel thixotropic anhydrous stable non-crusting cream antiperspirant compounds therewith in accordance with the principles of this invention.

The present invention will be better understood and objects and important features other than those specifically enumerated above will become apparent when consideration is given to the following details and description which, when taken in conjunction with the annexed drawing describes, discloses, illustrates and shows certain preferred embodiments or modifications of the present invention and what is presently considered and believed to be the best mode of practicing the principles thereof. Other embodiments or modifications may be suggested to those having the benefit of the teachings herein, and such other emodiments or modifications are intended to be reserved, especially as they fall within the scope and spirit of the subjoined claims.

BRIEF SUMMARY OF THE INVENTION

In accordance with the present invention, spray dispensing of a metered quantity of a preferably semi-liquid product is achieved from a filled substantially rigid container having a fixed wall provided with at least one and preferably a plurality of generally open and unobstructed discharge passageways. One wall of the container comprises a moveable wall spaced apart from the fixed wall which is impacted with a moving mass to induce a pressure pulse of very short time duration in the product. The pressure pulse is sufficient to surge a metered quantity of product less than the entire content of the container as noodles through the discharge passageway with sufficient velocity as to break away from the passageway and the remaining product within the container. The noodles ballistically travel generally normal the fixed wall outwardly of the container. With proper selection of product formulation and energy levels a plurality of uniform discharge passageways may produce a generally uniformly moving cluster of generally uniformly defined and moving particles with minimal inhalables. The cluster of particles may be aimed toward a target surface and the deposition pattern thereon may, by proper selection of energy and product, define a projection of the discharge passageway pattern selectively comprising either a discrete projection of the individual discharge passageways or a generally uniform coverage of the passageway locus set. The fixed wall may be generally planar, whereby the particles of the cluster will move along generally parallel paths or may be selectively generally concave or convex with the passageway axes converging or diverging whereby the particle paths will generally converge or diverge, respectively.

A specific, preferred embodiment of the present invention comprises a hand holdable, hand operable non-contact dispenser for and in combination with a stable, non-crusting anhydrous, thixotropic antiperspirant cream to provide metered and uniform non-contact spray applications thereof to axilla surfaces without, in general, imparting any undesirable, cold, wet or sticky sensation.

The preferred embodiment uses one light follower as the moveable wall impacted by a single heavier hammer-like impact mass accelerated by a spring and freely moving when it strikes the moveable wall. Multiple orifices or discharge passageways are provided in the fixed wall to dispense a single product dose. Multiple followers/cylinders each with individual or multiple orifices or discharge passageways also are feasible for dispensing a single dose in accordance with this invention.

No breakup is required of the particles after they leave the discharge passageways of the fixed wall. The target pattern is achieved by virtue of the geometric orientation of the discharge passageways. One primary spot of product shows up at the target for each discharge passageway. The size of the spot is a function of the size of the passageway orifice, the pressure pulse, and the product properties. Particle breakup may, however, occur.

The critical requirement of this dispensing mechanism is the pressure pulse created by the impact. Without the rapid cut-off nature of the pressure pulse, the product might not break away from itself at the exit orifice of each passageway. The noodle extrusion must be accelerated and then decelerated fast enough to allow the inertia of the product outside the orifice to break away from that still in the passageway and to then continue traveling on to the target. The larger the particle of product and distance between orifice and target, the greater the energy that must be transferred to the product from the impact. The major portion of the product within the container remains essentially static and it is believed that only a pressure wave is transmitted through the product, to be converted to velocity only at the product surface portions exposed through the generally open and unobstructed discharge passageways in the preferred embodiment.

Product forms other than a thick, rigid cream can be dispensed with the methods and from the apparatus of the present invention. However, dry powders and runny creams might not be easily retained in the orifices or discharge passageways, except by auxiliary retention or closure means.

The properties of the product must obviously fit this dispensing approach. The product must be rigid enough to prevent flow out of the orifice or discharge passageways prior to the application of the pressure pulse. It should be resistant to deterioration or changes of properties when exposed to air at the discharge passageways since they are generally open and unobstructed. Of course, a protective overcap or other closure means may be provided to be removed or opened manually or automatically, without departing from the present invention. The products' surface tension, viscosity, yield point, and related properties should allow it to be extruded and separated with a minimal energy input. The product should also, when designed to be deposited on a target surface, adhere to the target surface, preferably without rebound.

In the preferred embodiment of the apparatus of the present invention, a compression spring is manually cocked and triggered by a single user motion to accelerate the hammer-like impact mass. Alternative energy sources may include compressed gases, explosive caps, electric solenoids, magnetic fields, and other spring configurations. Also, the follower or moveable wall which rests against the product could be replaced by a diaphragm.

While no breakup of the product particles is required after they leave the dispenser to provide a spray-like delivery, high speed photographs have revealed that, in fact, with real products the tenacity and cohesiveness result in the noodles extruded remaining attached for a finite time to the product remaining in the discharge passageways, with the connecting product stringing out finer and finer until it breaks apart into small generally uniform particles trailing behind the larger noodle droplets. None-the-less, few inhalable droplets are formed and, with proper product, dispensers, and energy level selection, there is no explosion or shattering of any product droplets and substantially all of the extruded product remains in the ballistically travelling cluster which also, in general does not diverge into a cone as would occur with conventional spray nozzles, unless the dispenser is specifically designed to provide divergence. The discharge passageways may be generally cylindrical or may be slightly divergent or convergent and the fixed wall may be, if desired, generally concave or convex rather than generally planar and/or the passageway axes may also converge or diverge.

It also appears, in general, that if a uniform nonexpanding cluster of particles is desired and the effective prevention of inhalables, the product should be devoid of any trapped gas or other relatively compressible elements, since they would tend to explode the product noodles upon their being extruded from the discharge passageways, disrupting the spray pattern and dissipating the impulse energy. In addition, for the application of products to a skin surface, obviously the product particle velocity should be sufficiently low as to be not uncomfortable when the particles strike the skin.

It is an important feature of the present invention that the amount of product dispensed at each actuation is uniform and constant, depending upon the impact energy of the hammer-like impact mass when it strikes the follower. Hence, if the hammer-like impact mass is accelerated by a uniform spring force, for example, with a uniform spring compression for each actuation, and allowed to then freely travel for impact with the moveable wall of the canister, its impact energy will be independent of the depth of product within the canister and a uniform metered quantity of product will be dispensed.

It also appears to be an important feature that the fixed wall retain the bulk of the product mass against movement. Hence, the total cross-section area of the discharge passageways apparently must be substantially less than the area of each of the fixed wall and the moveable wall or follower. Also, since pressure is believed to be the primary energy transfer medium within the product, the fixed and moveable walls need not be equal in area nor parallel in orientation. Discharge even at right angles to the direction of impact is even possible.

BRIEF DESCRIPTION OF THE DRAWING

Although the specification concludes with claims particularly pointing and distinctly claiming the subject matter regarded as forming the present invention, it is believed that the invention will be better understood and objects and important features other than those specifically enumerated above will become apparent from the hereinafter set forth detailed description of the invention taken in conjunction with the annexed drawing, in which:

DETAILED DESCRIPTION OF A PREFERRED EMBODIMENT

Figure 1:
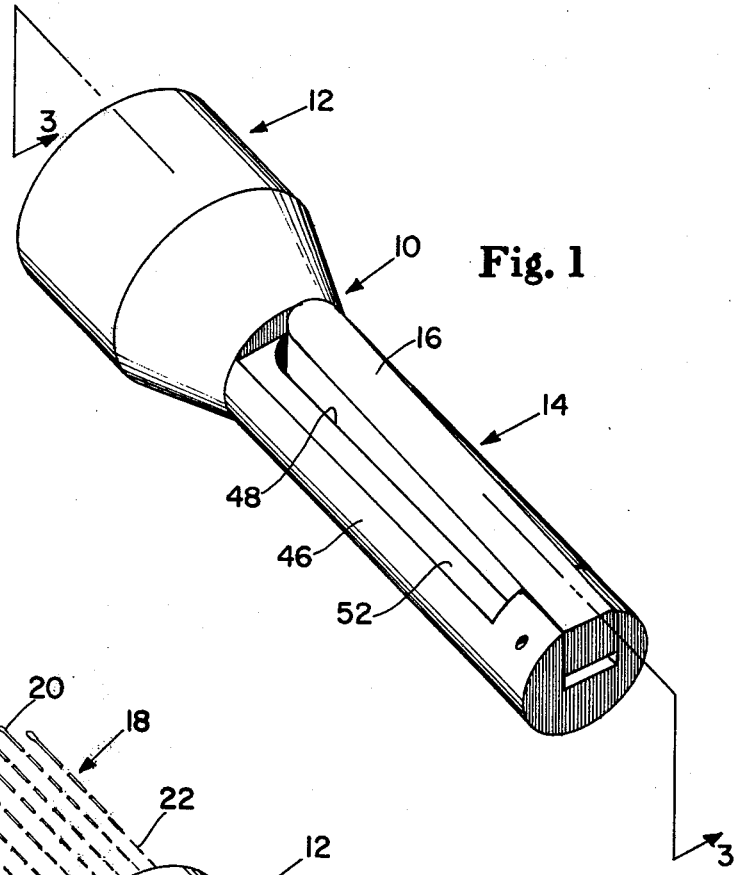
FIG. 1 is a perspective illustration of a spray dispenser incorporating the principles of the present invention.

With reference now to the drawing, and particularly to FIGS. 1–5 thereof, there is shown and illustrated a spray dispenser embodying the principles of the present invention and designated generally by the reference character 10. The dispenser 10 preferably comprises means for containing a quantity of product for measured spray dispensing such as a product canister 12 structurally associated with energizing means for accelerating an impact mass for impact thereagainst to induce a pressure pulse within the product and thereby spray dispense a metered quantity of product therefrom. The dispenser 10 may, without departing from the broader aspects of this invention, be of substantially any desired shape, size and configuration commensurate with the product to be dispensed, the metered quantity thereof to be dispensed by each impact pulse, the number of charges or metered quantities to be delivered before refill or replacement is required, the level of the energy per pulse required, the size of the spray pattern desired, the distance the spray must travel, the discharge velocity desired, the cycling rate desired, and the like. Moreover, the dispenser 10 may be substantially self-contained, wherein the container is normally substantially emptied before being refilled or replaced or may be connected with a supplemental product source wherein product may be essentially continuously supplied to replenish the supply in the product canister 12 or from which make up quantities of product may be supplied intermittently, such as, for example following each discharge cycle.

Moreover, the means for accelerating the impact mass may also be designed for relatively infrequent actuation, as for consumer product dispensing, or for highly repetitive actuation, as by shop air, power lines, or the like, as for foreseeable commercial/industrial segment applications, even including high speed multiple operation per minute cycling providing substantially uninterrupted spraying of product material.

In accordance with a preferred embodiment, however, the dispenser of the present invention is especially applicable to the consumer sector spray dispensing of a novel cream antiperspirant product where generally only a single daily dose application from a single or a few actuations per axilla is generally what is desired. For such use the dispenser should be comfortable to be hand held, directed, aimed and actuated by a typical consumer. As such, the dispenser 10 should not, in general, exceed about 6–8 inches (15–20 cm) in length, about 1½–2½ inches (4–6 cm) across the grip area, and about 2–2½ lbs. (1 kg) in weight, with the impact mass delivering an energy pulse not exceeding about 2–3 in.-lb.

Figure 2:
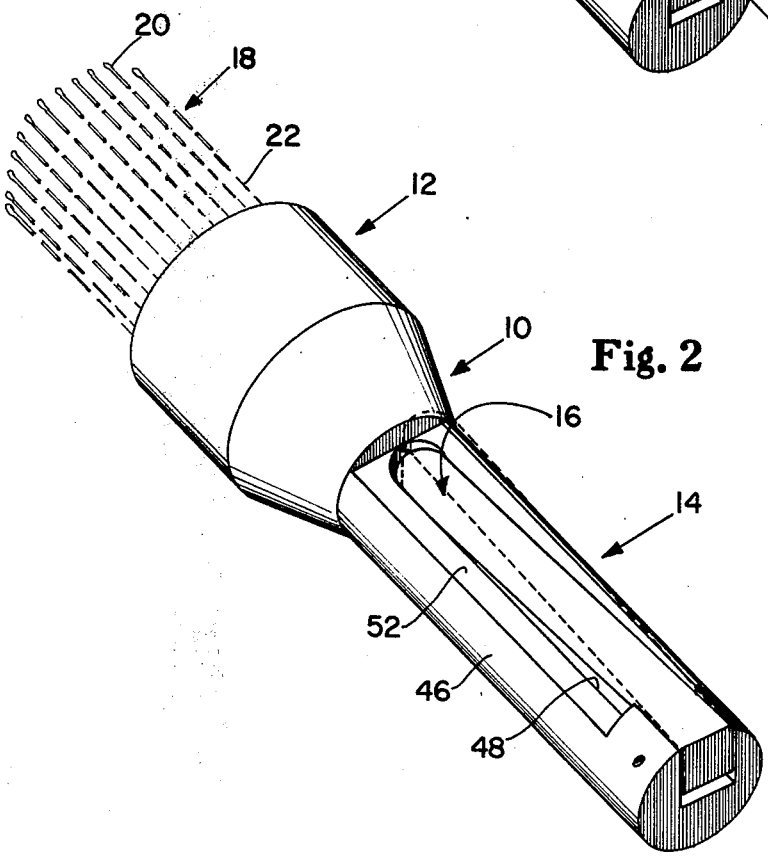
FIG. 2 is a perspective illustration of the spray dispenser of FIG. 1 illustrating the operation thereof.

Being designed to enable the exemplary dispenser 10 to be hand held, the means for supplying the impact impulse may conveniently, as shown, comprise an energizing helve 14 (the term helve being used to indicate that it functions as fully half the dispenser, providing a grip portion as well as mechanical utility). The helve 14, in turn, carries a hand actuable trigger 16 moveable between a normal, unactuated position shown in solid lines in FIGS. 1 and 3 and phantom lines in FIG. 2 and an inwardly depressed actuated position, shown in solid lines in FIGS. 2 and 4. Inward movement of the trigger 16, as by being hand squeezed by a user, is effective to produce a spray or cluster 18 of product particles ballistically ejected from the product canister 12, as schematically illustrated in FIG. 2 and as photographically shown in FIGS. 13, 14 and 15. The spray or cluster 18 of particles of product in general comprises sets of primary and secondary product particles designated 20 and 22, respectively.

The product canister 12 may comprise a generally rigid annular side wall 24 defining a generally cylindrical bore 26 closed at a forward end portion by a substantially rigid fixed wall 28 provided with at least one and preferably a plurality of generally open and unobstructed discharge passageways 30. Slidable within the bore 26 in spaced apart relationship to the fixed wall 28 there is provided a moveable wall or follower 32 to define within the canister 12 a product chamber 34 which may be filled with a quantity of semi-liquid product 36. While the moveable wall or follower 32 is slidable within the bore 26, it should have a tight enough fit to minimize product leakage between the side wall 24 and the follower 32. In practice, a 0.012 inch diametral gap appears satisfactory for use with antiperspirant creams as hereinafter described.

Figure 6:
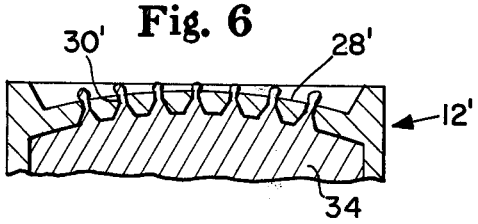
FIGS. 6 and 7 are partial cross section views similar to FIG. 4 of modified dispensers in accordance herewith, providing diverging and converging spray patterns.
Figure 7:
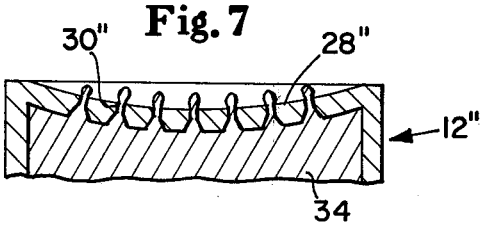

In the dispenser 10 of FIGS. 1–5, the fixed wall or orifice plate 28 is generally planar so that the particles of product as they move generally perpendicularly outwardly thereof move along generally parallel paths, without diverging as would occur in conventional spray mechanisms. However, the spray may, if desired, be made to converge or diverge by making the fixed wall 28 outwardly concave or convex and for the passageway axes otherwise convergent or divergent, respectively. Hence, and with reference to FIGS. 6 and 7, there are shown and illustrated, respectively, modified product canister 12' and 12'' having an outwardly convex fixed wall 28' with outwardly divergent passageways 30' and an outwardly concave fixed wall 28'' with outwardly convergent passageways 30'', from which the product will be dispensed in a generally diverging and converging spray pattern, respectively.

A "semi-liquid" product, as used herein, both in the description and hereinafter in the claims is intended to be used to describe products that can be satisfactorily spray dispensed with the apparatus and process herein described to define a metered cluster of ballistically ejected generally uniformly defined and formed particles, as herein described, disclosed, illustrated and shown. Quantitative descriptions of the properties leading to prediction of successful results, as defined by the quality of particle uniformity in size and trajectory, have not yet been achieved. Representative products that are successful are disclosed herein, but it is not the intention hereof to limit the scope of the present invention, in its broader aspects, to any particular product formulation.

Suitable "semi-liquid" products are, in general, thick or viscous so that they exhibit little tendency to run or flow under gravitational attraction and therefore preferably do not flow out of the generally open and unobstructed discharge passageways 30 until the pressure pulse is induced by, for example, the energizing helve 14 and then, only the desired metered quantity of product is ejected from the generally open and unobstructed discharge passageways as is determined by the magnitude and duration of the pressure pulse induced in the product by the impact mass. antiperspirant compounds are set forth hereinafter. In addition, tests by which "semi-liquids" may be easily identified are hereinafter described and disclosed. While in its preferred embodiments the invention sprays a uniform cluster of a semi-liquid product the invention is not limited thereby, however, and in its broader aspects may be used to dispense other flowable materials which do not form uniform product droplets, such as products which do explode or break up after or during exit from the discharge passageways.

The canister 12 may be sold or supplied as a disposable package, sold or supplied pre-filled with the product 36. Alternatively, the canister 12 may be refillable. To enable the canister 12 to be sold or supplied pre-filled and to enable quick and easy replacement thereof, the end portion of the side wall 24 generally opposite the fixed wall or orifice plate 28 may be provided with means, such as internal screw threads 38 for providing removable attachment of the canister 12 to the energizing helve 14.

The forward and rearward faces of the movable wall or follower 32 may be provided with counterbores or recesses 40 and 42, respectively. The side wall 24 may be extended generally forwardly of the forward wall or orifice plate 28, as shown, to provide an annular rim portion 44 surrounding the openings of the discharge passageways 30, enabling the spray device 10 or the product canister 12 to be placed on a table or other surface resting on the annular rim 44 with the forward wall or orifice plate 28 being raised therefrom.

The energizing helve 14 provides support for the canister 12 enabling the spray device 10 to be hand-held and actuated for spray ejection therefrom of the metered quantity of product constituting the cluster 18 of product particles. The dynamics of the helve 14, together with the diameter and mass of the moveable wall or follower 32, determine the magnitude and duration of the pressure pulse and, dependent upon the product characteristics and size and number of discharge passageways, the quantity of product ejected. The generally cylindrical configuration of the helve 14 also enables the dispenser 10 to be aimed or directed for the ballistic delivery of the cluster 18 of particles 20 and 22 which are discharged from the generally open and unobstructed discharge passageways 30 in a spray pattern determined primarily by the size, number and pattern of the open and unobstructed discharge passageways 30 across the fixed wall or orifice plate 28 relative the magnitude of the pressure pulse induced and the product characteristics. In the illustrated embodiments, the fixed wall 28, 28' and 28'' are generally transverse the longitudinal axis of the helve 14 and, particularly, the handle portion thereof. Since, however, it is believed to be primarily pressure, rather than velocity that is transmitted through the product from the follower 32 to the fixed wall 28 (or 28' or 28''), the fixed wall need not be parallel the follower 32 nor even transverse the helve 14.

While it is not our desire to be limited to any specific theory as to how the pressure pulse is absorbed by the product, nor as to how it travels through the product to extrude the product at high velocity from the discharge orifices or passageways, it appears that when the lightweight moveable wall or follower 32 is impacted, a pressure pulse is transmitted through the product to the portion thereof filling the passageways in the fixed wall 28. As the yield point of the product is exceeded, noodles are extruded from each discharge passageway 32 for the duration of the pressure pulse. As the noodles stop extruding, the portion of each noodle no longer confined by the discharge passageway walls breaks away from that portion still within the discharge passageway 32. The short noodles or particles then ballistically traverse the air between the orifice plate or fixed wall 28 and the target (if any) with essentially no change in direction, except due to gravitational and windage forces.

When multiple discharge passageways 30 are used, no breakup is required of the particles after they leave the orifice plate or fixed wall 28. The target pattern is achieved by virtue of the geometric orientation of the passageways across the orifice plate. One primary spot of product shows up at the target for each passageway. The size of the spot is a function of the size of the passageway, the product characteristics, the energy transfer, and the relative sizes and masses of the impact mass and the follower.

The larger the diameter of the canister the heavier the follower or moveable wall 32 generally are and the more flexible are the canister or container walls and the orifice plate or fixed wall 28. The follower or moveable wall 32 are generally heavier, not only because of the diameter, but also because larger diameters require longer sidewalls to prevent cocking.

Not only has the characteristics of the product necessary for optimal spraying not yet yielded to mathematical analyses such that optimization could be predicted accurately without trial and error, but also have the energy requirements failed to yield to accurate mathematical prediction. However, some generalization can apparently be made. Hence, if it is the pressure pulse in the product that determines delivery rate and how well it breaks away from the passageways and remaining product, then for maximum product discharge for a given energy level it is believed advantageous to induce the highest pressure pulse possible.

Impulse generated force is a function of the time of impact for a constant energy level. It is this force which establishes the pressure pulse. $P=F/A$. Thus, the lower the area of the moveable wall or follower 32 for a given impulse, the higher will be the magnitude of the pressure pulse.

The heavier the product moveable wall or follower 32 the slower it will accelerate and therefore the longer the time of the impulse and lower the force creating the pressure pulse.

Flexibility of the canister acts to dampen the pressure pulse. The smaller the canister the more rigid it is.

From the above reasoning, it was speculated that a smaller diameter follower will require less impact energy to deliver the same amount of product per impact and with the same breakaway characteristics.

This was verified as follows: a $2\frac{3}{8}$ inches ID canister and a $1\frac{5}{8}$ inches ID canister were fabricated both with the same wall thickness, same orifice pattern, and same depth of product. These canisters were subjected to impact by drop testing of a weight against followers of the same diameter as the canister bore (inside diameter) using a common weight and height. The delivery rate from each canister was measured.

| Canister Diameter | Drop Weight | Drop Height | Product | Product Depth | Moveable Wall Wt. | Measured Delivery |
|---|---|---|---|---|---|---|
| $1\frac{5}{8}$in. | .20 lb. | 10" | Example II | $\frac{3}{8}$in. | 16.22 gm. | .542 gm |
| $2\frac{3}{8}$in. | .20 lb. | 10" | Example II | $\frac{3}{8}$in. | 32.72 gm. | .201 gm. |

| No. of Orifices | Fixed Wall Thickness | Orifice Diameter | Orifice Length | Annular Wall Thickness | Canister Material |
|---|---|---|---|---|---|
| 45 | 3/32 in. | .046 in. | .030 in. | 3/16 in. | Celcon |
| 45 | 3/32 in. | .046 in. | .030 in. | 3/16 in. | Celcon |

Example II cream is the product described in detail hereinafter in Example II at page 43 and with reference to FIG. 12.

The delivery from the smaller diameter canister was, therefore, 270% of that from the larger canister.

The ratio of areas is $4.43/2.07=2.14:1$

Thus, it would be predicted that the pressure pulse in the small canister would be 214% of the pressure pulse in the large canister and the delivery from the small canister would be 214% of the delivery from the large canister. The delivery is actually 270% for the small canister, somewhat greater than the theoretical value. This is believed to be at least partly explained by the fact that the larger diameter canister had more flexible walls to absorb some of the pressure and a larger follower weight to reduce the impulse generated force.

In general, the experiment did confirm that follower diameter affects the delivery rate as was postulated. The smaller the follower, the greater the delivery per impact when all else is constant. In addition, the differing velocities and product delivery rates resulted in significant changes in the deposition of the product on the target surface.

Figure 8:
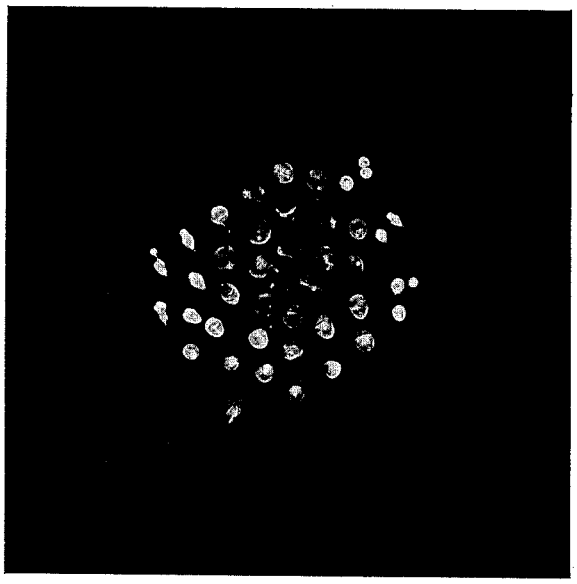
FIGS. 8 and 9 are photographs of two exemplary surface deposition patterns achieved by spraying semi-liquid products with the methods and apparatus of the present invention ballistically onto target surfaces.
Figure 9:
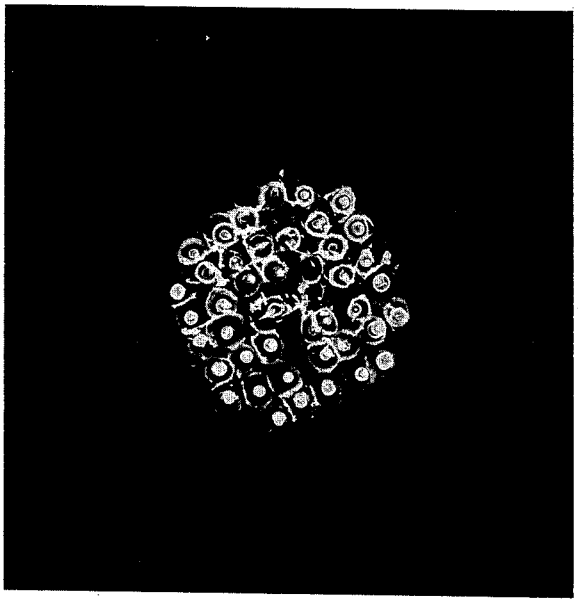

FIGS. 8 and 9 are photographs, essentially full size, of the product deposition pattern resulting on a black target surface from each of the two trials described immediately hereabove.

FIG. 8 shows the deposition pattern from the $2\frac{3}{8}$ inch diameter canister. It may be readily seen that a single small primary spot of product essentially appears for each of the 45 discharge passageways. Hence, the deposition pattern defines a projection of the discharge passageway pattern providing a discrete projection of the individual discharge passageways.

FIG. 9 is a similar photograph which shows the product deposition pattern from the 1⅝ inch diameter canister. As can be seen, the deposition pattern also defines a projection of the discharge passageway pattern and one single primary spot of product essentially appears for each of the discharge passageways. However, the product spots are seen to be much larger, apparently because of both the increased product delivery rate per discharge passageway and the probably increased velocity of the product particles at impact on the target. Hence, while the distribution of the spots still corresponds to a projection of the discharge passageway pattern, on the target the spots have each spread to partially overlap and merge to provide a generally uniform coverage of the passageway locus set.

Passageway cross-sections other than round can be used, and slots have successfully dispensed product. However, the use of slots rather than round holes is not as satisfactory, the resulting spray pattern lacking the uniformity resulting from round holes.

An additional study was conducted to determine product delivery rate (volume/impact) and repeatability under controlled energy delivery. The impact energy was provided by dropping a weight through a known distance. Since potential energy of an elevated weight is WH, where W=lbs. and H=inches, then E=in.-lb. of energy. The weight measured 83.5 gm. or 0.184 lbs. The drop height varied from 8 in. to 24 in. The canister and follower were 2¼ inch in diameter.

Experiment 1: The weight was dropped from an 8 in. drop height five times and sprayed product collected on the same tared card. The card was weighed after each drop and recorded. Energy developed per drop from 24 holes 1/16 in. diameter ×⅛ inches long was calculated to an average weight per shot of 0.22 gm. ±0.01 gm. and each impact was within 5% of this value.

Experiment 2: The weight was dropped from several heights. The energy developed for each impact was calculated and the product sprayed in each impact was collected on a separate tared card which was weighed. The amount of product delivered at each energy level for each drop from 24 holes 1/16 in. diameter×⅛ in. long using the formula of Example II hereafter (Page 46) is as shown in the following table and in the graph, FIG. 10.

| Test No. | Drop Ht. | Energy | Wt./Shot |
|---|---|---|---|
| #1 | 8" | 1.47 in. | .22 gm. |
| #2 | 14" | 2.58 in. | .34 gm. |
| #3 | 20" | 3.68 in. | .40 gm. |
| #4 | 26" | 4.78 in. | .46 gm. |

Figure 10:
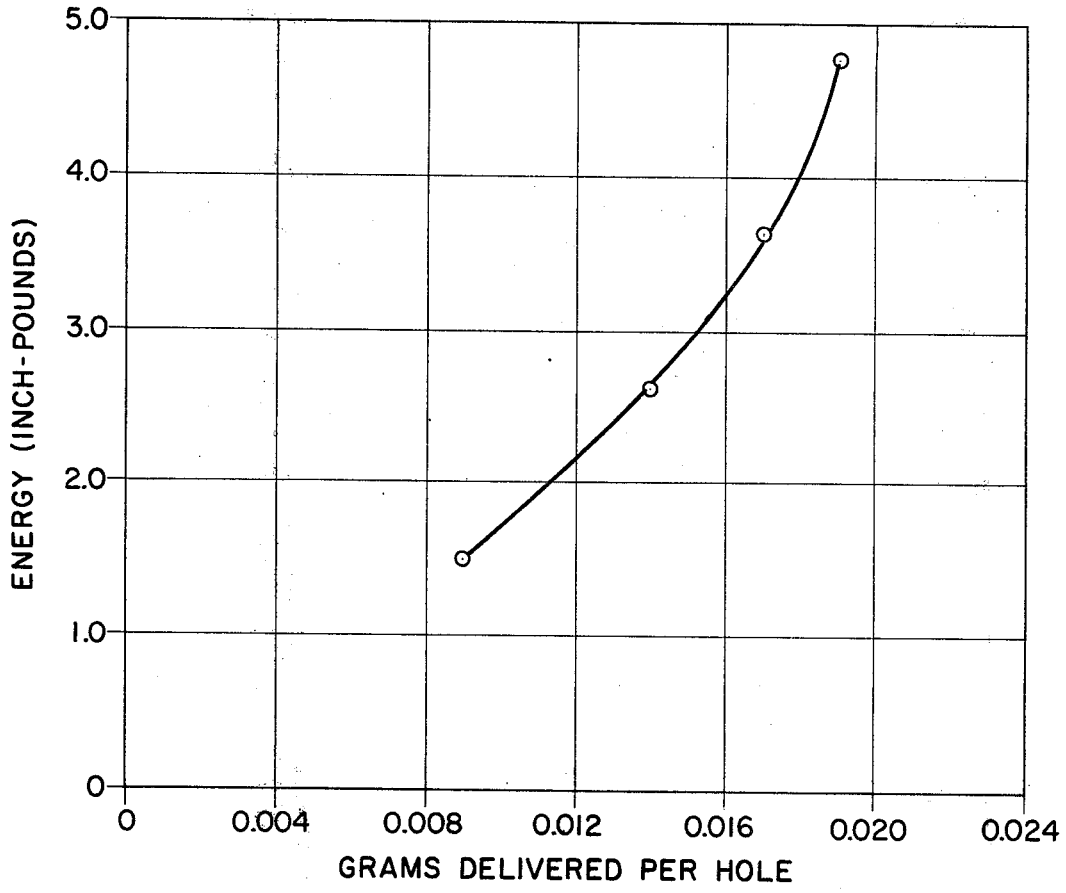
FIGS. 10, 11 and 12 are graphs illustrating various characteristics of the operation of the present invention.

On tests 3 and 4, rebound was evident to a large degree. The product had bounced off the cardboard target onto the device's orifice plate and skirt. Hence, the high end of the graph of FIG. 10 is skewed towards the left to an unknown degree, but increased energy input clearly results in increased product being dispensed.

Figure 11:
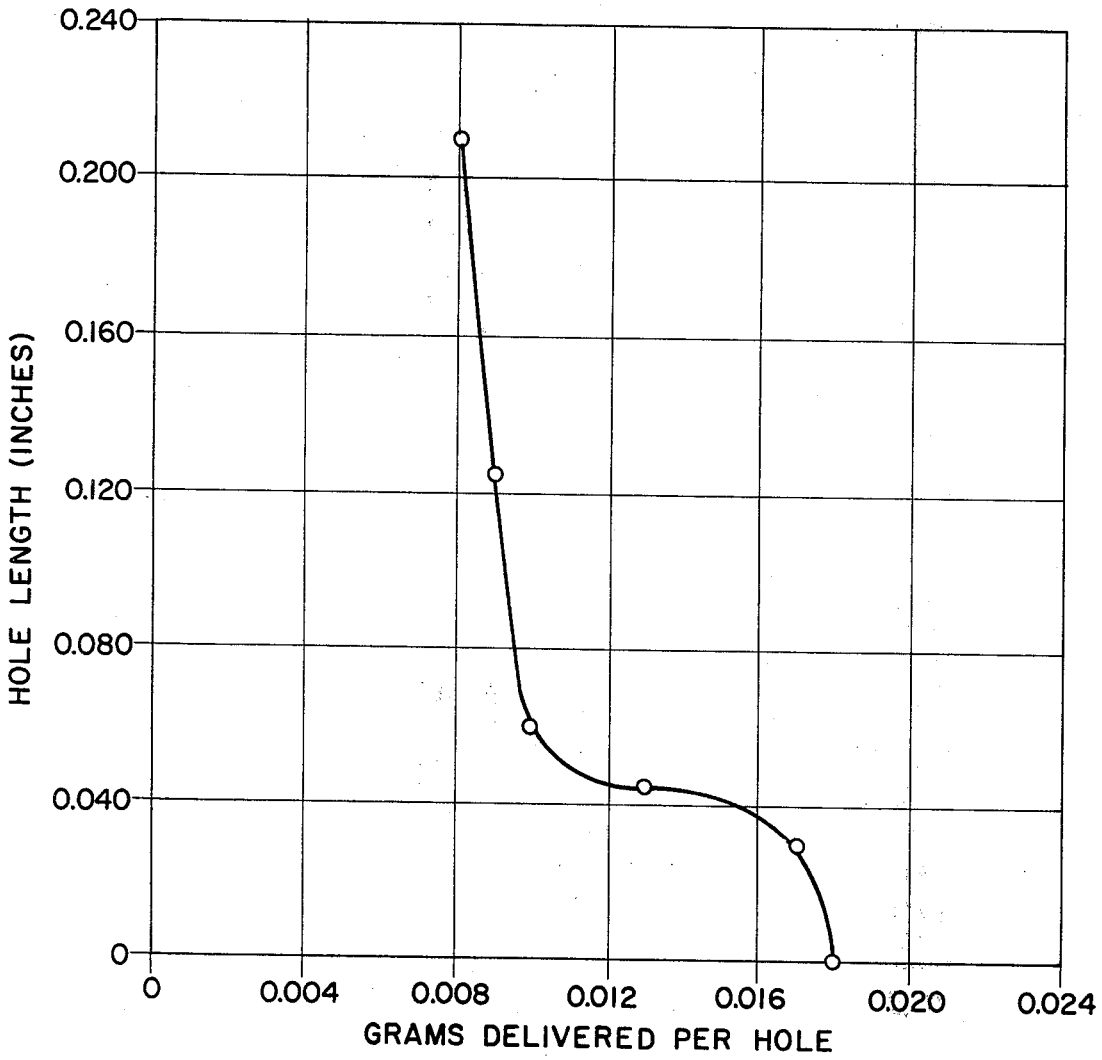

In FIG. 11, there is shown a graph wherein delivery rate utilizing the same dispenser; (i.e., 24 holes, 2¼ in. diameter canister) is compared against hole length. The energy pulse was supplied by a falling 0.184 lb. weight dropped 11 inches. The hole diameter was 0.063 inches. The curve indicates that, at least for this product, for maximum delivery for a given energy input, the orifice or passageway length should be kept as short as possible since, at larger ratios, the amount of product dispensed decreases markedly. The product was that of Example III, described in detail hereinafter, page 47. The graph also shows that, since product delivery weight can be affected by the length of the discharge passageway, variations in passageway length can be used to provide a mechanism for effecting varying delivery rates for the same energizer and product.

Figure 12:
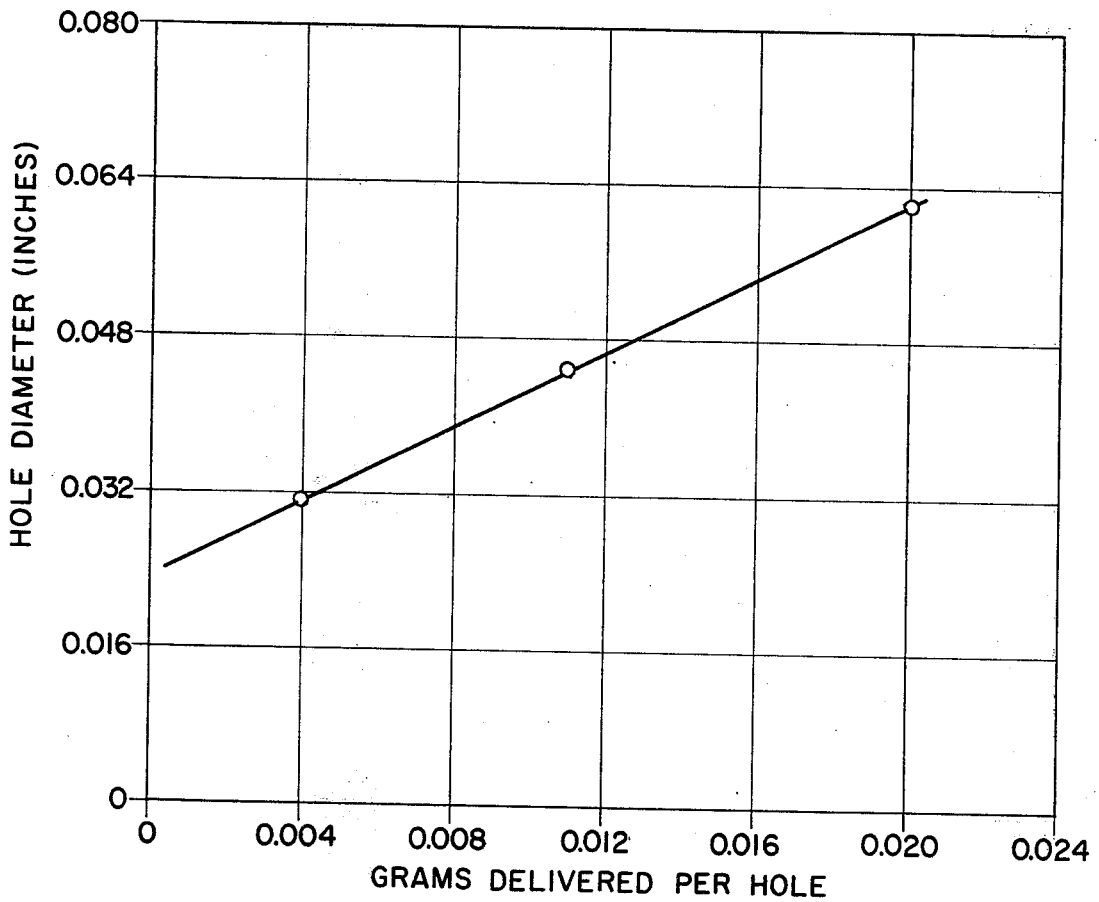
Figure 13A:
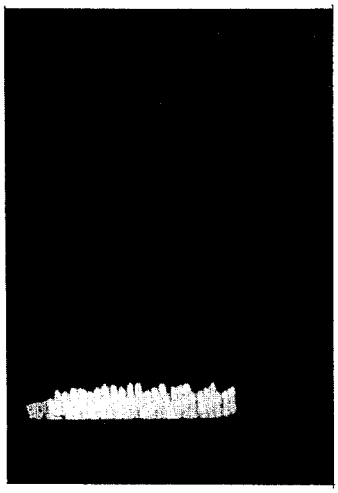
FIGS. 13, 14 and 15 are sequences of high speed photographs showing the mode of operation of the spray dispenser of the present invention, utilizing different combinations of product formulation and discharge passageway configurations.
Figure 13B:
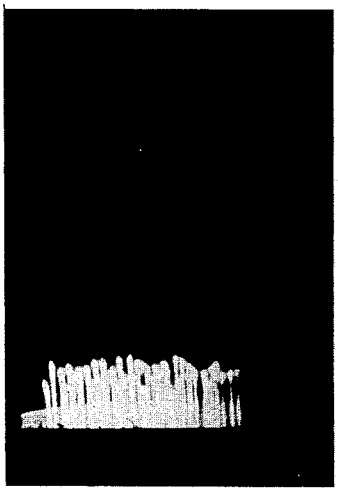
Figure 13C:
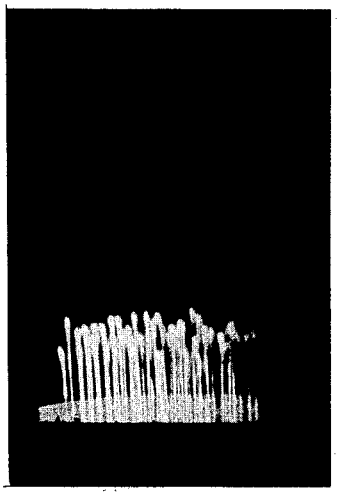
Figure 13D:
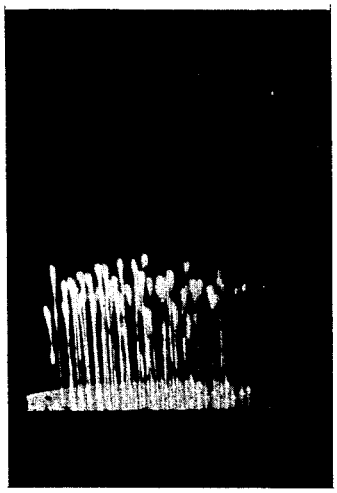
Figure 13E:
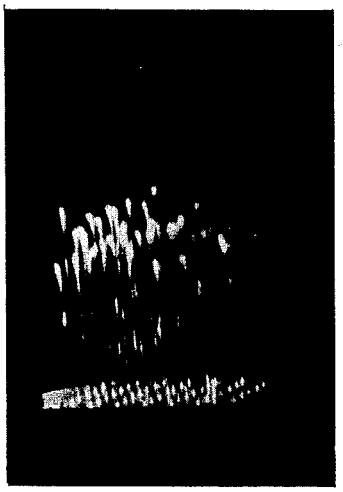
Figure 13F:
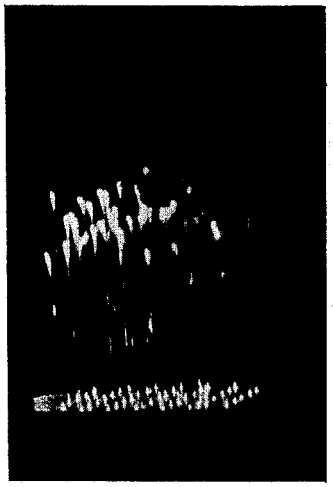
Figure 13G:
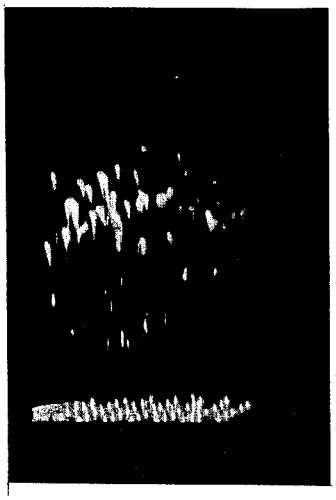
Figure 13H:
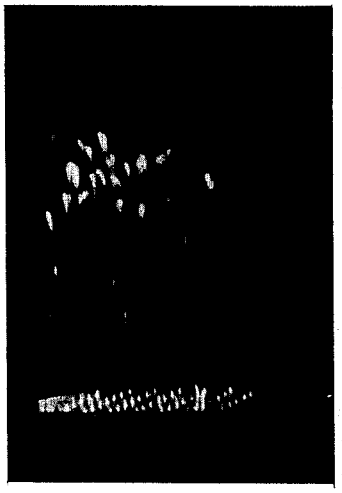
Figure 13I:
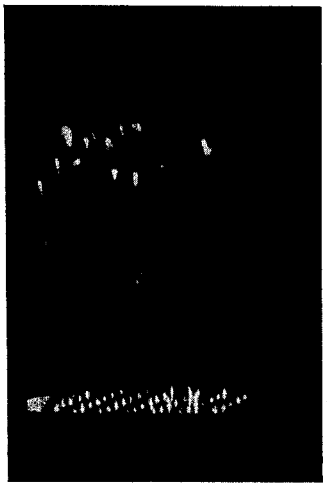
Figure 14A:
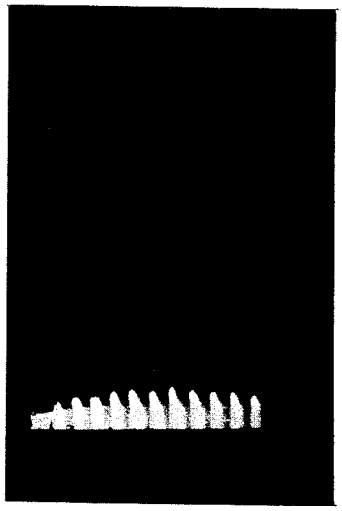
Figure 14B:
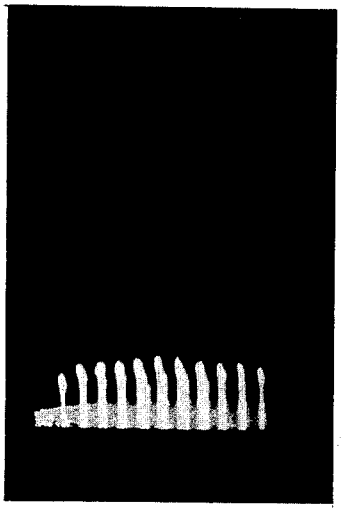
Figure 14C:
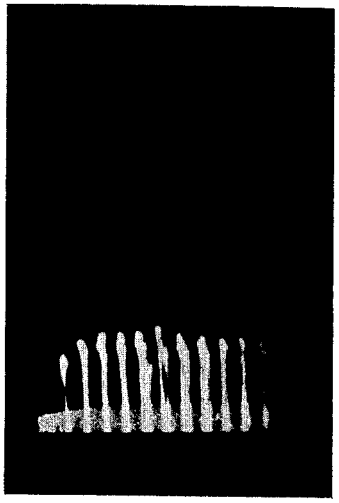
Figure 14D:
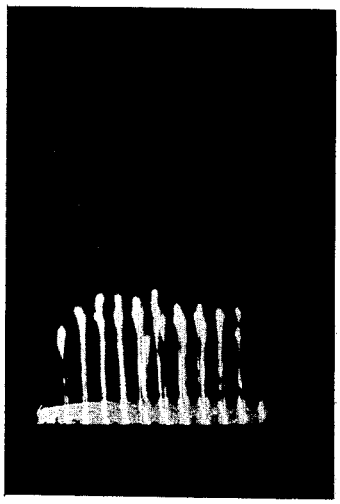
Figure 14E:
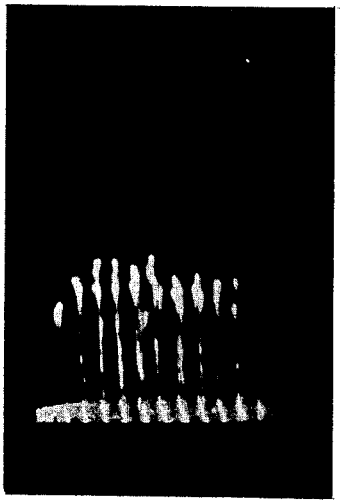
Figure 14F:
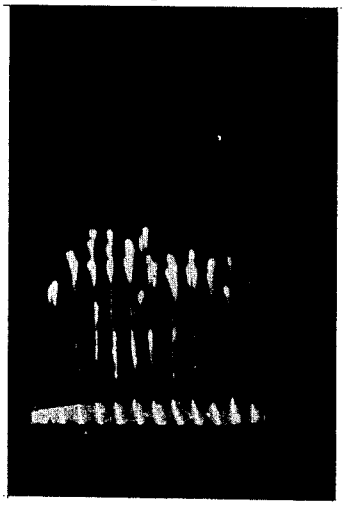
Figure 14G:
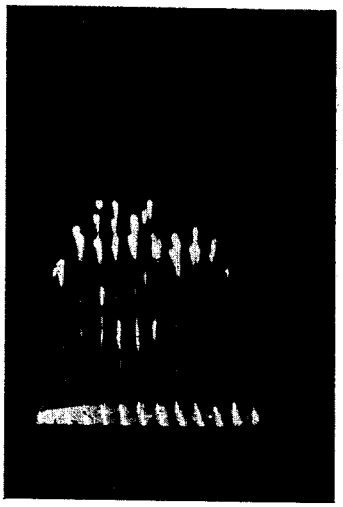
Figure 14H:
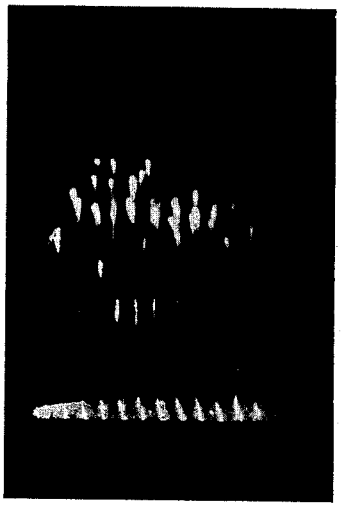
Figure 14I:
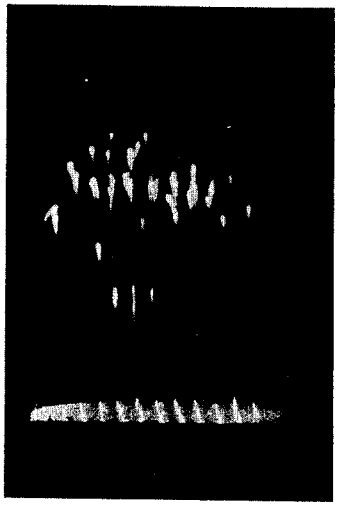
Figure 15A:
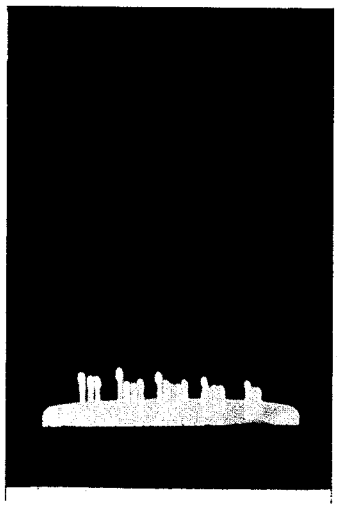
Figure 15B:
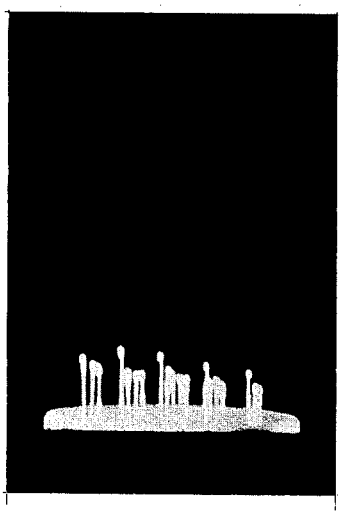
Figure 15C:
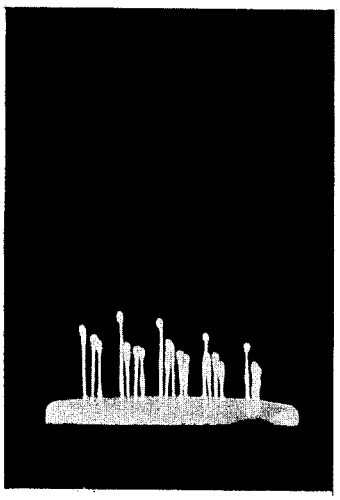
Figure 15D:
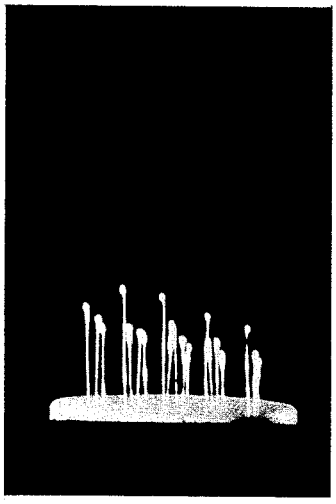
Figure 15E:
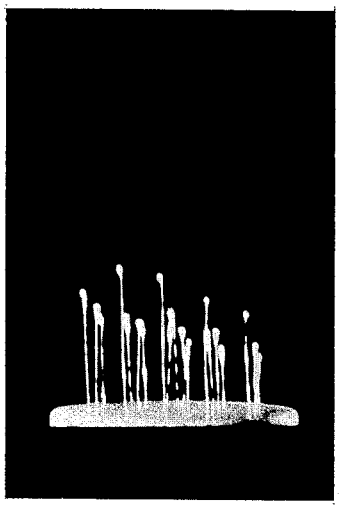
Figure 15F:
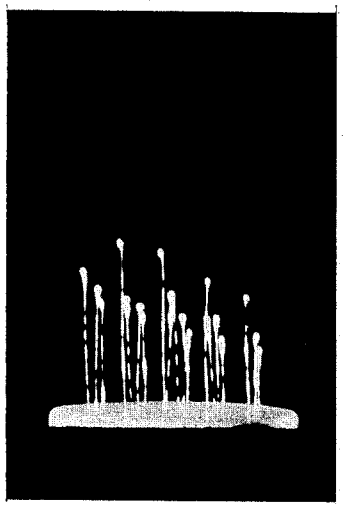
Figure 15G:
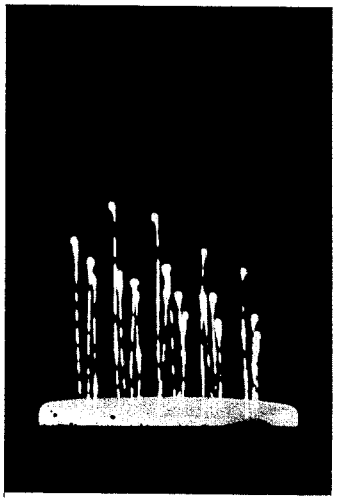
Figure 15H:
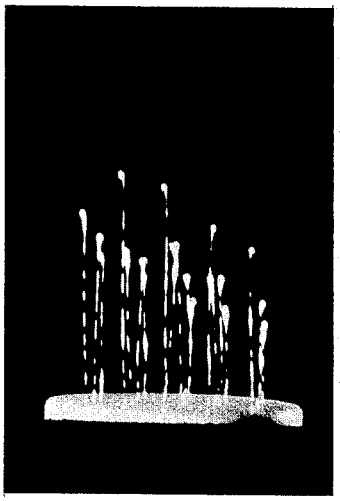
Figure 15I:
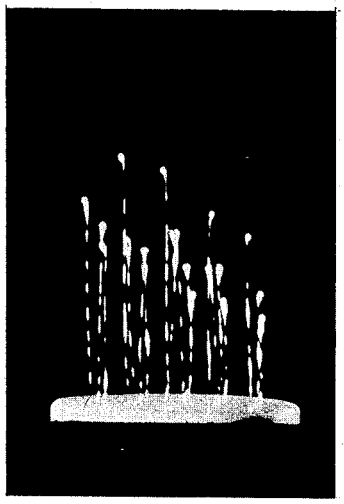

In FIG. 12, the same product (i.e., Example III) the same dispenser (i.e., 2¼ in. diameter) and same impulse input (i.e., 0.184 lb. weight falling 11 inches) was used to plot the delivery rate through 24 passageways of 0.065 inch lengths with differing diameters. The graph shows a nearly perfect linear relationship between hole diameter and grams delivered.

As heretofore pointed out, substantially any flowable product may be dispensed using the present invention providing only that it can be retained in the container and discharge passageways; that is, it will not run or leak from the unit when not actuated. The limits of flowability, wherein the product will break away from the unit and fly to the target area when actuated yet will not run or leak from the unit when not actuated, are hard to define on an absolute basis, since factors other than simple viscosity seem to be important. As a guideline, however, and bearing in mind the preferred embodiment wherein the dispensers of the present invention is to be hand held and actuated, discharge passageway diameter between about 0.007 and 0.125 inches, were judgementally assumed to be about the minimum and maximum diameters at all consistent with hand held, hand actuated dispensing. With these discharge passageway diameter limits, some guideline limits on flowability can be defined, using some exemplary fluids.

Hence, for example, a lower limit was defined by using various dimethylpolysiloxane fluids furnished by Dow Corning Corporation under the trademark Fluid 200. The least viscous one of these fluids which did not flow from the discharge passageway during static conditions had a kinematic viscosity of about 26.4 centistokes as designated by Dow Corning and as determined by Dow Corning Corporate Test Method CTM 0004 dated July 29, 1970 entitled "VISCOSITY-Glass Capillary Viscometer" and available from Dow Corning Corporation, Midland, Mich. The test measures the time required for a fixed volume of sample to pass through a calibrated glass capillary using "gravity-flow" and interpolates the time to the times of fluids standardized according to ASTM D2162. The method is based on ASTM D445.

Various Fluid 200 dimethylpolysiloxane fluids were tested for suitability as to flowability in a 2.5 inch diameter canister, with a 0.007 inch hole 0.020 inches long, supported statically with the fluid above the hole. Fluids less viscous than the 26.4 centistoke sample flowed excessively through the hole. Capillary action caused only a low level of leakage of the 26.4 centistoke sample. Normal unit orientation (e.g. upright) could presumably eliminate this capillary leakage action if the hole length exceeded the capillary rise in that hole. An impulse force within the parameters tested can deliver this fluid through this hole.

The upper limit for viscosity of anhydrous antiperspirant cream formulations of the type described in the Shelton application and the hereinafter described examples was measured by needle penetration and determined to be 46 mm penetration of a 83 mm conical needle with a taper of about 9% and about a 0.15 mm diameter ball tip under 100 g. loading for 5 sec. (using ASTM D1321-70) for product which can be applied from a 2.5 inch diameter piston, with a ⅛ inch 0.020 inches long hole, driven by a 20-inch pound impulse. An impact impulse of 20-inch pounds is approximately 10 times the energy of the preferred embodiment and double that of the mechanically unaided person.

Figure 5:
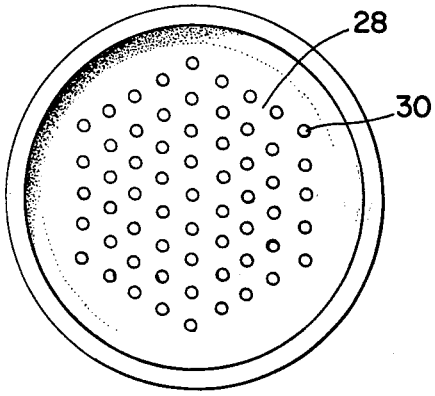
FIG. 5 is an end view taken along line 5—5 of FIG. 4.

Hence, it is apparent that many combinations of product formulation, impulse input, canister size, and discharge passageway size, number and pattern are possible and that variation in any or all of these factors may produce changes in the spray pattern and deposition pattern of the product. At the present time, a balancing of these factors has resulted in a judgmental setting of these parameters, for spraying of an antiperspirant product cream as set forth hereinafter as Example II, to define a preferred embodiment to comprise a canister of 2¼ inch I.D. with its fixed wall being ⅛ inch thick and provided with 120 discharge passageways arranged in a hexagonal array (as shown in FIG. 5) on 5/32 center to center spacing with each being 0.035 inch in diameter by 0.030 inch in length and having a 3/32 internal countersink to be actuated by 2 in-lb of energy by a 0.15 lb. hammer against a 0.03 lb. follower with a 2¼ inch outside diameter.

With renewed reference now to FIGS. 1–5, the energizing helve 14 has a generally cylindrical handle portion 46 having a longitudinally extending groove 48 within which the trigger 16 is hinged, as by a pintle or pin 50. The handle portion 46 is also provided with a recess 52 providing access to the trigger 16 by the user's hand or fingers even while the trigger 16 is being depressed to its actuated position, enabling operation thereof by a simple squeeze motion of a user's hand. A generally longitudinally extending bore 54 and a generally longitudinally extending slot 56 are provided, the slot 56 connecting the groove 48 with the bore 54. The groove 48 and slot 56, in addition to enabling movement of the various actuating elements, also provide vents of the bore 54 to the atmosphere. Sufficient venting of the various impulse delivering elements is important to avoid any pneumatic dampening or cushioning.

The forward end portion of the energizing helve 14 may comprise a hammer cup 56 provided with a generally circular hole or bowl 58 extending generally perpendicularly inwardly from the hammer cup front face 60. The front face 60 may be generally perpendicular the bore 54. The hammer cup 56 may also be provided with an externally threaded shoulder 62 onto which the canister 12 can be assembled. Contained within the bowl 58 of the hammer cup 56 is slidably disposed a hammer-like impact mass 64 comprising a stem portion 66. The hammer 64 is freely moveable within the bowl 58 and the stem portion 66 thereof may be slidably guided within the bore 54 for reciprocating movement perpendicular the hammer cup front face 60. Reciprocation of the hammer 64, guided by the stem portion 66, enables the front face 70 of the hammer 64 to impact against the movable wall of follower 32 of the canister 12 to provide the pressure pulse within the product 36 to initiate the spray operation.

The hammer 64 is provided with a passage 68 extending from the impact face 70 of the hammer 64 generally longitudinally concentrically through the stem portion 66 thereof. The passage 68 provides both a vent path through the hammer 64 to preclude any air dampening or cushioning thereof and a channel within which there may be disposed a hammer return spring 72. The hammer return spring 72 biases the hammer 64 inwardly of the hammer cup 56 and bowl 58. The hammer return spring 72 exerts, at all times a return force against the hammer 64 exceeding the weight of the hammer 64 to enable the dispenser to be operated in any orientation. The hammer return spring 72 may extend from the passage 68 into the lower end of the bore 54. The hammer return spring 72 may be a helical extension spring having hooked ends, one end which is attached to a hammer retaining pin 74 extending transversely of the hammer 64 through the passage 68.

At the other end of the bore 54 of the handle portion 46, there is provided a counterbore 76 terminating at a forward shoulder 78. Within the counterbore 76 there may be reciprocally contained a slide member 80. The slide member 80 may comprise a lug portion 82 extending transversely outwardly thereof into the slot 56. The slide 80 also may comprise a forward driving face 84 which, in the forward most position of the slide 80, may engage the shoulder 78 of the counterbore 76.

Figure 3:
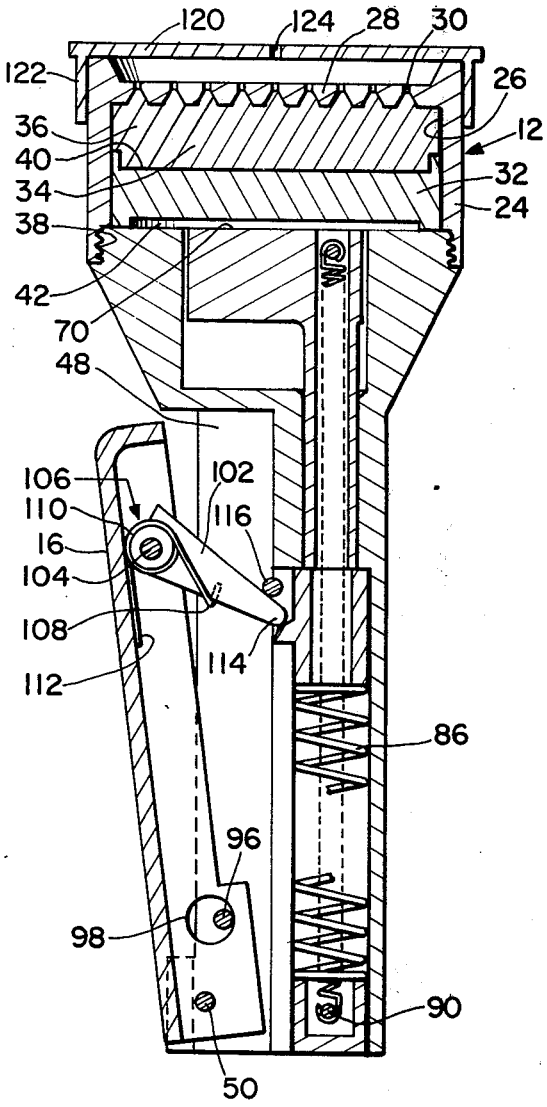
FIG. 3 is an enlarged cross sectional illustration taken along line 3—3 of FIG. 1.

The hammer 64, including the stem portion 66 thereof, may be of a length substantially equal to the length of the bore 54 between the hammer cup face 60 and the counterbore shoulder 78 so that, as shown in FIG. 3, when the slide impact face 84 is engaged against the shoulder 78 of the counterbore 76 the impact face 70 of the hammer 64 is in general planar alignment with the forward face 60 of the hammer cup 56 and spaced apart from the movable wall or follower 32 by the depth of the rearward recess 42 of the follower 32, all as shown in FIG. 3, which illustrates the dispenser 10 in the unactuated configuration.

Behind the slide 80, and within the counter bore 76, there may be provided a mainspring 86 which, as shown, may comprise a helical compression spring having either plane or ground ends. The mainspring 86 may be retained within the counterbore 76 by a plug member 88 held, in turn, by a retaining pin 90 extending transversely therethrough and into the handle portion 46 on either side of the counterbore 76. The slide 80 may be provided with a central passage 92 in general alignment with passage 68 of the hammer stem 66. The plug 88 may be of generally cup-like configuration containing a bore 94 through which the retaining pin 90 may pass. The mainspring 86 preferably may have an outside diameter slightly less than the inside diameter of the counterbore 76 and greater than the diameter of the slide passage 92 and cup 94 of the plug 88 and a free height generally somewhat more than the distance separating the slide 80 from the plug 88 such that the mainspring 86 will be compressed by rearward movement of the slide 80. The hammer return spring 72 may pass generally freely through the passage 92 of the slide 80, generally through the center of the mainspring 86, and into the cup 94 of the plug 88 so that the lower looped end thereof may be held by the retaining pin 90.

The preferred spring energizers for the illustrated antiperspirant dispenser use a 0.15 lb. hammer 64. However, part of the user input energy never reaches the hammer 64, being absorbed by mechanical losses. The mainspring 86 and slide 80 weigh 0.02 lb. The hammer return spring 72 absorbs additional user input energy depending on whether the canister 12 is full or near empty.

Not all of the kinetic energy of the hammer 64 is transferred to the product to create a pressure pulse of sufficient magnitude to cause a discharge. A pendulum or drop test cannot accurately simulate this transfer of energy, because tests have also shown that the rigidity of the cannister support is extremely important. A hand-held device will dispense only about half the product of a rigidly supported cannister. Pendulum and drop tests simulate only the rigid support. Apparently, the illustrated compression spring hand-held dispenser allows about half of the impact energy to be dissipated in moving the hand and arm.

Similarly, the rigidity of the product cannister components is important. If the fixed wall having the discharge passageways 30 is flexible or an inelastic collision occurs between moveable wall or follower 32 and the hammer 64, significant energy is absorbed by materials other than the product, thereby reducing the pressure pulse. Flexibility also apparently allows vibrations or reflected pressure waves in the canister after impact to extrude a small amount of additional product from the discharge passageways, simulating poor breakaway.

The trigger 16, as heretofore pointed out, may be pivoted within the groove 48 about the pintle or pin 50. There may also be provided a stop pin 96 extending across the groove 48 to pass through an aperture 98 provided within the trigger 16. The pin 96 may therefore limit outward pivot movement of the trigger 16 to its normal, nonoperative position, as shown in FIG. 3.

Figure 4:
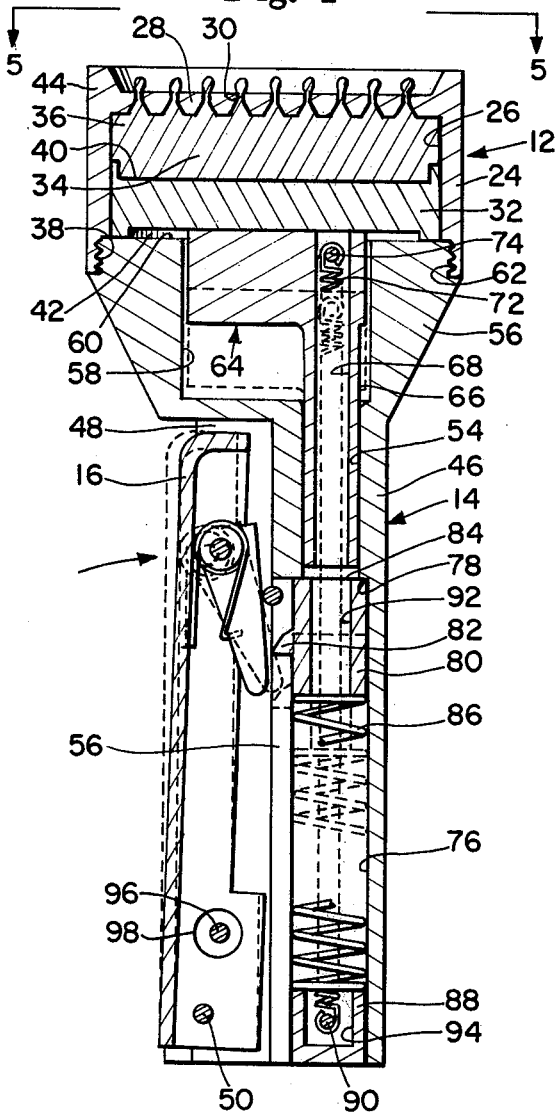
FIG. 4 is an enlarged cross sectional illustration similar to FIG. 3 at the instant immediately following actuation.

Pivotably carried by the trigger 16, there may also be provided a toggle link 102 pivotably associated with the trigger 16 by means of a link pin 104 and biased for counterclockwise movement relative thereto, as by means of a link spring 106. The link spring 106, as shown, may comprise a wishbone spring having a tang portion 108 engaging the toggle link 102, a coil portion 110 surrounding the link pin 104 and a tail portion 112 engaging the trigger 16. The toggle link 102 may be provided with a rounded a nose portion 114 which may engage the lug portion 82 of the slide 80 as shown in FIGS. 3 and 4. There may also be provided a trip pin 116 extending transversely of the groove 48 positioned, for example, partially within the slot 56 and cooperating with the toggle link 102.

Inward movement or rotation of the trigger 16 will therefore cam the slide 80 rearwardly, compressing the mainspring 86. Such compression of the mainspring 86 enables the hammer spring 72 to retract the hammer 64 into the bowl 58 of the hammer cup 56. This rearward movement of the hammer 64 and slide 80 continues until the trigger 16 approaches its inmost rotative position substantially completely within the groove 48. At such inmost rotative position, the forces exerted on the toggle link 102 by the trip pin 116 and the lug portion 82 of the slide 80 cam the toggle link sufficiently clockwise (as viewed in the drawing) into a tripped position, shown in solid lines in FIG. 4. The lug portion 82 is thereat released from engagement with the toggle link 102, enabling the mainspring 86 to accelerate the slide 80 forwardly within the counterbore 76. The engagement the impact face 84 of the slide 80 against the rearward face of the hammer stem 66, maintained by the hammer inertia and the biasing from the hammer spring 72, accelerates the hammer 64 forwardly with the slide 80 until the impact face 84 of the slide 80 engages the shoulder 78 of the counterbore 76. The slide 80 will stop upon engagement of the shoulder 78.

The momentum of the hammer 64 will, however, carry the hammer 64 further forwardly, as shown in solid lines in FIG. 4, against the slight restraining force of the hammer return spring 72 until the impact face 70 of the hammer 64 knocks or impacts once against the moveable wall or follower 32 of the product canister 12 and ideally transferring its momentum to the moveable wall or follower 32 and therethrough to provide a single pressure pulse in the mass of product 36. Ideally, it is believed, although we have not been able to prove it, this pressure pulse delivered to the product absorbs substantially all of the momentum of the hammer 64 and generates a single pressure pulse within the mass of product 36. The single pressure pulse generated within the quantity of product 34 filling the canister 12 between the moveable wall or follower 32 and the forward fixed wall or orifice plate 28 then causes expulsion of a metered quantity of the product 34 outwardly through the discharge passageways 30. In FIG. 4 there is illustrated the product just starting to be ejected through the discharge passageways 30 at the instant of impact of the hammer 64 against the moveable wall or follower 32. Following the single impact and inducement of the pressure pulse the hammer spring 72 returns the hammer 64 to its initial position, as shown in FIG. 3, and relieves, therefore, all pressure from the moveable wall or follower 32 which also has moved slightly forwardly to decrease the volume within the product canister or container 12 by an amount equal the volume of the product 36 dispensed. Release of the trigger 16 allows the trigger spring 106 to re-set the trigger 16 and toggle link 102 for another operation.

A removable protective cap 120 having an annular skirt portion 122 and vent means, such as a vent hole 124 may be provided to protect the product 34 against excessive exposure to the air. The vent hole 124 prevents any pressure differential developing during assembly or storage across the product mass 30, the back of the moveable wall or follower being in turn, as heretofore detailed, vented through the helve 14.

The dispenser 10 can be repetitively operated in the above manner until the product 36 is substantially entirely exhausted from the product canister 12 and the moveable wall or follower 32 has moved forwardly into engagement with the fixed wall 28. Experience has shown, however, that as the moveable wall or follower 32 closely approaches the fixed wall or orifice plate 28, erratic spray operation results. The reason for such erratic operation is not known but it appears to be related to a need for the retention of sufficient product 36 between the moveable wall or follower 32 and the fixed wall 28 to absorb the impact induced pressure pulse and transmit it uniformly across the fixed wall 28 and discharge passageways 30. Hence, the moveable wall or follower 32 is provided, as hereinbefore set forth, with the forward facing counterbore or recess 40 so that a small amount of the product 36 is retained within the recess 40 so as to be distributed across the fixed wall or orifice plate 28 and across all of the generally open and unobstructed discharge passageways 30 extending therethrough even as the moveable wall or follower 32 bottoms out or engages the inside of the fixed wall or orifice plate 28 annularly around the rim circumscribing the set of generally open and unobstructed discharge passageways 30.

EXAMPLE I

With reference now to FIGS. 13 and 14, high speed photographs clearly show the spraying of a cream product from apparatus of the present invention illustrating the mode of spray formation.

The cream utilized consisted of the following formulation (by weight):

| | |
|---|---|
| Isopropyl myristate | 54.73% |
| Bentone 27 | 6.08% |
| Propylene carbonate | 2.02% |
| Cetyl alcohol | 4.75% |
| Perfume | 0.75% |
| Impalpable aluminum chlorhydroxide | 31.67% |
| Total | 100.00% |

Bentone 27 is a hydrophobically treated montmorillonite clay which has a particle size of below about 5 microns and is commercially available from the NL Industries, Inc. (formerly National Lead Company). Bentones in general are prepared by reacting bentonite in a cation exchange system with an amine. Bentonite is a colloidal, hydrated aluminum silicate obtained from montmorillonite and has the formula $Al_2O_34SiO_2.H_2O$. A more detailed discussion of bentonite can be found in the *Kirk-Othmer Encyclopedia of Chemical Technology*, 2nd. Ed., Vol. 3 (1964), pp. 339–360, published by Interscience Publishers, which is incorporated herein by reference. Bentone 27 is described in greater detail in technical bulletin F-71-66 from the National Lead Company entitled "BENTONE 27", which is incorporated herein by reference.

The cream may be prepared by admixing the isopropyl myristate, cetyl alcohol and perfume together. The Bentone 27 is then added and mixed with a suitable agitating device for several minutes to form a uniform composition. The propylene carbonate may then be added under continued agitation until gellation occurs. Once a thixotropic gel has formed, particulate aluminum chlorhydrate (having a particle size preferably from about 1–100 microns, more preferably from about 1–50 microns) may then be blended into the thixotropic mixture, which may be heated to a temperature of about 50° C., and uniformly dispersed and suspended throughout.

Various types of mixing or agitating means may be employed for preparation of such a composition. For example, the isopropyl myristate, cetyl alcohol, perfume, Bentone 27 and propylene carbonate can be admixed in a colloid mill or Osterizer to form the thixotropic gel matrix. Suspension of the aluminum chlorhydrate within the thixotropic gel can be accomplished by a Hobart mixer or colloid mill.

In preparing the photographs, FIGS. 13 and 14, the above product formulation was spray dispensed from a canister by impact in accordance with the present invention. Each of FIGS. 13 and 14 comprises a sequence of high speed photographs taken with a HYCAM Model 41-0004 high speed rotating prism camera manufactured by Redlake Corporation of Santa Clara, California, at 3,000 frames per second on 16 mm movie film. After processing, the individual movie frames were photographed on 35 mm negative film and alternate frames were printed to produce FIGS. 13 and 14. Hence, each of the individual frames a-j in FIGS. 13 and 14 are separated by a time interval of two-three thousandths of a second or, one fifteen hundredths second equal to approximately six hundred and sixty-six microseconds.

In photographing the sequences, the camera was started and then the impulse mass tripped. In selecting the frame "a" for each of FIGS. 13 and 14, the first frame upon which product expulsion could be discerned was chosen. The canister end or fixed wall, which was, in this instance, 2 inches in diameter, can be seen in the lower portion of each frame. The canister wall was provided with 45 discharge passageways, each 0.045 inches in diameter by 0.030 inches length. The impact mass was 0.145 pounds and applied approximately three inch pounds of impact.

FIGS. 13 and 14 represent two sequences photographed from slightly differing angles, FIG. 13 was photographed first, then FIG. 14. From the photographs it can be readily seen that the product discharge occurs primarily as the extrusion of a slug or noodle of product substantially simultaneously from each of the discharge passageways. As the noodle or slug of product is projected outwardly from the discharge passageways tenaciousness of the product draws a tail behind each primary product slug or particle which, as is clearly shown in the photographic sequences, are drawn finer and finer until they break up into secondary clusters of smaller particles trailing behind the cluster or front of primary particles. As is also clearly shown in the photographic sequences, the particles do move ballistically along generally parallel trajectories generally normal the face of the dispenser. It is also apparent that, at least with this combination of product formulation, discharge orifice size and impact that substantially only a single pressure pulse provides the noodle extrusion. Other high speed photographs have, however, on occasion indicated multiple pulses with certain combinations of product and dispenser for reasons which are not presently understood. In accordance with our preferred embodiment, however, the uniform single pulse produced cluster of uniform particles as shown in the photographs is preferred.

EXAMPLE II

FIG. 15 is a sequential photograph similar to those of FIGS. 13 and 14 and prepared in a similar manner. However, the canister has been provided with a fewer number of discharge passageways, namely, 18. Moreover, a slightly different antiperspirant product, prepared in the same way as the previous example but having the following formulation (by weight) was used:

| | |
|---|---|
| Isopropyl myristate | 66.90% |
| Bentone 27 | 6.08% |
| Propylene carbonate | 2.02% |
| Cetyl alcohol | 4.75% |
| Perfume | 0.75% |
| Impalpable aluminum chlorhydroxide | 19.50% |
| Total | 100.00% |

Comparison of FIG. 15 with FIGS. 13 and 14 indicates some interesting similarities and distinctions, although the reasons therefore are not known. Firstly, the particle velocity appears to be substantially the same. However, the primary product particles are much more clearly defined, as is the breakup mechanism for the elongating tails. The cream extruded in the photographs of FIG. 15 has a substantially higher ratio of oil to solids wherein the oil is defined as being the total of the isopropyl myristate, propylene carbonate and perfume with the solids being defined as the total of Bentone, cetyl alcohol and alumnium chlorhydroxide. Overall, the product formulation and passageway arrangement of Example II appears to provide a better spray definition than Example I.

EXAMPLE III

Another antiperspirant formulation which has found utility in combination with the methods and apparatus of the present invention containing the following proportions of ingredients (by weight):

| | |
|---|---|
| Isopropyl myristate | 37.40% |
| Bentone 38 | 3.74% |
| Propylene carbonate | 0.94% |
| Ethanol | 9.35% |
| Perfume | 1.87% |
| Aluminum chlorhydroxide | 46.70% |
| Total | 100.00% |

Bentone 38 is another amine treated montmorillonite clay similar to Bentone 27 supplied by N.L. Industries, Inc. It is described in more detail in technical bulletin F-56-67 from the National Lead Company entitled "BENTONE 38", which is incorporated herein by reference. The Ethanol may comprise SDA 40 (i.e., Specially Denatured Alcohol) which has been denatured with 0.125% tertiary butyl alcohol or with 1.5 ounce per 100 gallons of brucene sulphate or brucene alkaloid. The cream may be compounded, for example, similar to the compounding of Examples I and II or may be compounded by sequentially mixing together at room temperature in, for example, a colloid mill, a Waring Blender or an Osterizer. The isopropyl myristate and Bentone, then the ethanol, the propylene carbonate, and finally the aluminum chlorhydroxide and perfume. Bentones in general must be incorporated with high shear dispersion, but alternatively, the cream may be compounded in a paddle mixer and be subsequently subjected to the needed high shear, as by means of a positive displacement pump.

The photographic analysis method utilized to produce the FIGS. 13–15 may be utilized to analyze substantially any desired fluid to ascertain its suitability for controlled spray discharge by the methods and apparatus of the present invention.

While the invention has been described, disclosed illustrated and shown in terms of certain embodiments or modifications which it has assumed in practice, the scope of the invention should not be deemed to be limited by the precise embodiments or modifications herein described, disclosed, illustrated or shown, such other embodiments or modifications as may be suggested to those having the benefit of the teachings herein being intended to be reserved especially as they fall within the scope and spirit of the claims hereto appended.

What is claimed is:

1. Method of dispensing a metered quantity of a preferably semi-liquid product from a filled substantially rigid container having a fixed wall provided with at least one generally open and unobstructed discharge passageway and a moveable wall spaced apart from the fixed wall comprising impacting the moveable wall with a moving mass to induce a pressure pulse of very short time duration in the product sufficient to surge a metered quantity of product less than the entire content of the container and dependent upon the momentum of the moving mass as a noodle through the discharge passageway with sufficient velocity as to break away from the passageway and the remaining product within the container to ballistically travel outwardly of the fixed wall.

2. Method of dispensing defined in claim 1 further comprising selecting the product formulation and the discharge passageway configuration relative the momentum of the moving mass so that the noodle dispensed from each discharge passageway substantially retains its integrity without any substantial breakup and is ejected from the fixed wall generally normal thereto.

3. Method of spray dispensing a metered quantity of a preferably semi-liquid product from a filled substantially rigid container having a fixed wall provided with a plurality of generally open and unobstructed discharge passageways and a moveable wall spaced apart from the fixed wall comprising impacting the moveable wall with a moving mass to induce a pressure pulse of very short time duration in the product sufficient to surge a metered quantity of product less than the entire content of the container and dependent upon the momentum of the moving mass as noodles through the discharge passageways with sufficient velocity as to break away from the passageways and the remaining product within the container to define a cluster of particles which ballistically travel outwardly of the container.

4. Method of dispensing defined in claim 3 further comprising selecting the product formulation and the discharge passageway configuration relative the momentum of the moving mass so that the noodle dispensed from each discharge passageway substantially retains its integrity without any substantial breakup and is ejected from the fixed wall generally normal thereto.

5. Method defined in claim 3 further comprising selecting the product formulation, the momentum applied, and the size, distribution and number of the plurality of discharge passageways to produce a generally uniformly moving cluster of generally uniformly defined and moving particles with minimal inhalables which may be aimed toward a target surface so that the deposition pattern thereon may define a projection of the discharge passageway pattern.

6. Method defined in claim 5 further comprising selecting the product formulation, the momentum applied, and the size, distribution and number of discharge passageways such that the deposition pattern comprises a discrete projection of the individual discharge passageways.

7. Method defined in claim 5 further comprising selecting the product formulation, the momentum applied, and the size, distribution and number of discharge passageways such that the deposition pattern comprises a generally uniform coverage of the passageway locus set.

8. Method of spray dispensing a metered quantity of a preferably semi-liquid product comprising providing a substantially rigid container with a fixed wall having at least one generally open and unobstructed discharge passageway and a moveable wall spaced apart from the fixed wall, filling the container between such fixed and moveable walls with a quantity of semi-liquid product, and impacting the moveable wall with a moving mass to induce a pressure pulse of very short time duration in the product sufficient to surge a metered quantity of product less than the entire content of the container as a noodle through each discharge passageway with sufficient velocity as to break away from the passageway and the remaining product within the container to ballistically travel generally normal the fixed wall outwardly of the container.

9. Method of spray dispensing a metered quantity of a preferably semi-liquid product comprising providing a substantially rigid container with a generally planar fixed wall having a plurality of generally open and unobstructed discharge passageway and a moveable wall spaced apart from the fixed wall, filling the container between such fixed and moveable walls with a quantity of semi-liquid product, and impacting the moveable wall with a moving mass to induce a pressure pulse of very short time duration in the product sufficient to surge a metered quantity of product less than the entire content of the container as noodles through the discharge passageways with sufficient velocity as to break away from the passageway and the remaining product within the container to ballistically travel as a cluster of particles generally perpendicular the fixed wall outwardly of the container.

10. Method of spray dispensing a metered quantity of a semi-liquid antiperspirant product comprising providing a substantially rigid container with a fixed wall having a plurality of generally open and unobstructed discharge passageways and a moveable wall spaced apart from the fixed wall, filling the container between such fixed and moveable walls with a quantity of semi-liquid antiperspirant product, and impacting the moveable wall with a moving mass to induce a pressure pulse of a very short time duration in the product sufficient to surge a metered quantity of product less than the entire content of the container as noodles through the discharge passageways with sufficient velocity as to break away from the passageway and the remaining product within the container to ballistically travel as a cluster of particles each moving along a path generally normal the fixed wall outwardly of the container for deposition without any substantial rebound onto an axilla surface.

11. Method defined in claim 10 wherein the energy applied by the impact mass comprises not more than about 3 inch pounds.

12. Method of non-contact application of a metered quantity of a semi-liquid antiperspirant product onto an axilla surface comprising providing a substantially rigid container with a fixed wall having a plurality of generally open and unobstructed discharge passageways and a moveable wall spaced apart from the fixed wall, filling the container between such fixed and moveable walls with a quantity of semi-liquid antiperspirant product, aiming the fixed wall towards and spaced apart from an axilla surface, and impacting the moveable wall with a moving pass to induce a pressure pulse of very short time duration in the product sufficient to surge a metered quantity of product less than the entire content of the container as noodles through the discharge passageway with sufficient velocity as to break away from the passageway and the remaining product within the container to ballistically travel from the fixed wall outwardly of the container for deposition without any substantial rebound onto the axilla surface.

13. Method defined in claim 12 wherein the energy applied by the impact mass comprises not more than about 3 inch pounds.

14. Apparatus for dispensing a metered quantity of a preferably semi-liquid product comprising a substantially rigid container adapted to be filled with the semi-liquid product and having a fixed wall provided with at least one generally open and unobstructed discharge passageway and a moveable wall spaced apart from the fixed wall and means for impacting the moveable wall with a moving mass to induce a pressure pulse of very short time duration in the product sufficient to surge a metered quantity of product less than the entire content of the container and dependent upon the momentum of the moving mass as a noodle through the discharge passageway with sufficient velocity as to break away from the passageway and the remaining product within the container to ballistically travel outwardly of the container fixed wall.

15. Apparatus defined in claim 14 wherein said means for impacting the moveable wall comprises a moveable impact mass, energizing means for accelerating the moveable mass to a velocity whereat it has the desired impact momentum, and means for guiding said mass for impacting against said moveable wall.

16. Apparatus defined in claim 15 adapted for manual operation wherein said energizing means comprises a mainspring, a trigger, and means connecting said trigger with said mainspring so that depression of said trigger sequentially cocks said mainspring and releases it to accelerate said moveable impact mass.

17. Apparatus defined in claim 16 further comprising return spring means for biasing said moveable mass towards said means for accelerating so that said moveable impact mass is automatically withdrawn from contact with said moveable wall substantially immediately following impact therewith and enabling the apparatus to be used in substantially any desired orientation.

18. Apparatus defined in claim 17 wherein said energizing means comprises an energizing helve structurally associated with said container and configured to be hand held and actuated by a user's hand squeeze.

19. Apparatus defined in claim 18 wherein said energizing helve comprises a generally elongated hand grip portion, said trigger being pivotally mounted therewith such that inward rotation of said trigger by a user's hand squeeze around said grip portion actuates the dispenser and said container comprises a removable canister carried by an end portion of said helve opposite said grip portion with the fixed wall generally transverse the longitudinal axis of said grip portion, enabling the dispenser to be hand held, aimed, and actuated.

20. Apparatus defined in claim 19 wherein said canister fixed wall is provided with a plurality of said generally open and unobstructed discharge passageways distributed thereacross whereby a cluster of product particles are sprayed from said fixed wall for each actuation of said energizing means defining a projection of the passageway distribution pattern.

21. Apparatus defined in claim 20 further comprising a quantity of antiperspirant cream product filling said canister whereby the dispenser may be directed toward an axilla surface to spray dispense a metered quantity of antiperspirant cream produce thereon in a deposition pattern defined by a projection of the passageway distribution pattern.

22. Apparatus defined in claim 21 wherein said antiperspirant cream product comprises a substantially anhydrous, stable, non-crusting, thixotropic cream comprising emollients, gelling agents, and antiperspirant actives which do not, in general, impart an undesirable, cold, wet or sticky sensation when applied to the skin.

23. Apparatus defined in claim 20 wherein said canister comprises a generally annular wall extending generally perpendicular said fixed wall generally circumscribing said plurality of discharge passageways and defining a generally cylindrical bore and wherein said moveable wall comprises a relatively lightweight substantially rigid follower slidable therewithin.

24. Apparatus defined in claim 23 wherein said follower is provided with a recess in the face thereof towards said fixed wall extending across the set of discharge passageways.

25. Apparatus defined in claim 20 wherein said fixed wall is generally planar so that the cluster of product particles may be spray dispensed to move along generally parallel paths outwardly thereof.

26. Apparatus defined in claim 20 wherein said fixed wall is generally outwardly convex with the axis of said passageways generally outwardly divergent so that, the cluster of product particles may be spray dispensed to move along generally divergent paths outwardly thereof.

27. Apparatus defined in claim 20 wherein said fixed wall is generally outwardly concave with the axis of said passageways generally outwardly convergent so that, the cluster of product particles may be spray dispensed to move along generally convergent paths outwardly thereof.

28. Apparatus defined in claim 15 wherein said energizing means comprises an energizing helve structurally associated with said container and configured to be hand held and actuated by a user's hand squeeze.

29. Apparatus defined in claim 28 wherein said container fixed wall is provided with a plurality of said generally open and unobstructed discharge passageways distributed thereacross whereby a cluster of product particles are sprayed from said fixed wall for each actuation of said energizing means defining a projection of the passageway distribution pattern.

30. Apparatus defined in claim 29 further comprising a quantity of antiperspirant cream product filling said canister whereby the dispenser may be directed toward an axilla surface to spray dispense a metered quantity of antiperspirant cream product thereon in a deposition pattern defined by a projection of the passageway distribution pattern.

31. Apparatus defined in claim 30 wherein said antiperspirant cream product comprises a substantially anhydrous, stable, non-crusting, thixotropic cream comprising emollients, gelling agents, and antiperspirant actives which do not, in general, impart an undesirable, cold, wet or sticky sensation when applied to the skin.

32. Apparatus defined in claim 20 wherein said canister comprises a generally annular wall extending generally perpendicular said fixed wall generally circumscribing said plurality of discharge passageways and defining a generally cylindrical bore and wherein said moveable wall comprises a relatively lightweight substantially rigid follower slidable therewithin.

33. Apparatus defined in claim 32 wherein said follower is provided with a recess in the face thereof towards said fixed wall extending across the set of discharge passageways.

34. Apparatus defined in claim 32 wherein said fixed wall is generally planar so that the cluster of product particles may be spray dispensed to move along generally parallel paths outwardly thereof.

35. Apparatus defined in claim 32 wherein said fixed wall is generally outwardly convex with the axis of said passageways generally outwardly divergent so that, the cluster of product particles may be spray dispensed to move along generally divergent paths outwardly thereof.

36. Apparatus defined in claim 32 wherein said fixed wall is generally outwardly concave with the axis of said passageways generally outwardly convergent so that, the cluster of product particles may be spray dispensed to move along generally convergent paths outwardly thereof.

37. Apparatus defined in claim 14 wherein said container fixed wall is provided with a plurality of said generally open and unobstructed discharge passageways distributed thereacross whereby a cluster of product particles are sprayed from said fixed wall for each actuation of said energizing means defining a projection of the passageway distribution pattern.

38. Apparatus defined in claim 37 wherein said fixed wall is generally planar so that, the cluster of product particles may be spray dispensed to move along generally parallel paths outwardly thereof.

39. Apparatus defined in claim 37 wherein said fixed wall is generally outwardly convex with the axis of said passageways generally outwardly divergent so that, the cluster of product particles may be spray dispensed to move along generally divergent paths outwardly thereof.

40. Apparatus defined in claim 37 wherein said fixed wall is generally outwardly concave with the axis of said passageways generally outwardly convergent so that, the cluster of product particles may be spray dispensed to move along generally convergent paths outwardly thereof.

41. Apparatus defined in claim 37 wherein said canister comprises a generally annular wall extending generally perpendicular said fixed wall generally circumscribing said plurality of discharge passageway and defining a generally cylindrical bore and wherein said moveable wall comprises a relatively lightweight substantially rigid follower slidable therewithin.

42. Apparatus defined in claim 41 wherein said follower is provided with a recess in the face thereof towards said fixed wall extending across the set of discharge passageways.

43. Apparatus defined in claim 37 further comprising a quantity of antiperspirant cream product filling said canister whereby the dispenser may be directed toward an axilla surface to spray dispense a metered quantity of antiperspirant cream product thereon in a deposition pattern defined by a projection of the passageway distribution pattern.

44. Apparatus defined in claim 43 wherein said antiperspirant cream product comprises a substantially anhydrous, stable, non-crusting, thixotropic cream comprising emollients, gelling agents, and antiperspirant actives which do not, in general impart an undesirable, cold, wet or sticky sensation when applied to the skin.

45. Apparatus defined in claim 44 wherein said fixed wall is generally planar so that, the cluster of product particles may be spray dispensed to move along generally parallel paths outwardly thereof.

46. Apparatus defined in claim 44 wherein the product formulation and the discharge passageway configuration relative the momentum of the moving mass are such that the noodle dispensed from each discharge passageway substantially retains its integrity without any substantial breakup and is ejected from the fixed wall generally normal thereto.

47. Apparatus defined in claim 44 wherein the product formulation, the momentum applied, and the size, distribution and number of the plurality of discharge passageways produce a generally uniformly moving cluster of generally uniformly defined and moving particles with miminal inhalables which may be aimed toward a target surface so that the deposition pattern thereon may define a projection of the discharge passageway pattern.

48. Apparatus defined in claim 47 wherein the product formulation, the momentum applied, and the size, distribution and number of discharge passageways are such that the deposition pattern comprises a discrete projection of the individual discharge passageways.

49. Apparatus defined in claim 47 wherein the product formulation, the momentum applied, and the size, distribution and number of discharge passageways are such that the deposition pattern comprises a generally uniform coverage of the passageway locus set.

50. Apparatus defined in claim 37 wherein the product formulation, the momentum applied, and the size, distribution and number of the plurality of discharge passageways produce a generally uniformly moving cluster of generally uniformly defined and moving particles with minimal inhalables which may be aimed toward a target surface so that the deposition pattern thereon may define a projection of the discharge passageway pattern.

51. Apparatus defined in claim 50 wherein the product formulation, the momentum applied, and the size, distribution and number of discharge passageways are such that the deposition pattern comprises a discrete projection of the individual discharge passageways.

52. Apparatus defined in claim 50 wherein the product formulation, the momentum applied, and the size, distribution and number of discharge passageways are such that the deposition pattern comprises a generally uniform coverage of the passageway locus set.

53. Apparatus for spray dispensing a metered quantity of a semi-liquid antiperspirant product comprising a substantially rigid container having a fixed wall provided with a plurality of generally open and unobstructed discharge passageways and a moveable wall spaced apart from the fixed wall, semi-liquid antiperspirant product filling the container between such fixed and moveable walls; and energizing means for impacting the moveable wall with a moving mass to induce a pressure pulse of very short time duration in the product sufficient to surge a metered quantity of product less than the entire content of the container as noodles through the discharge passageways with sufficient velocity as to break away from the passageways and the remaining product within the container to ballistically travel as a cluster of particles moving along paths generally normal the fixed wall outwardly of the container for deposition without any substantial rebound onto an axilla surface.

54. Apparatus defined in claim 53 wherein said energizing means comprises an energizing helve structurally associated with said container and configured to be hand held and actuated by a user's hand squeeze.

55. Apparatus defined in claim 54 wherein said energizing helve comprises a generally elongated hand grip portion having a trigger which is pivotally mounted therewith such that inward rotation of said trigger by a user's hand squeeze around said grip portion actuates the dispenser and said container comprises a removeable canister carried by an end portion of said helve opposite said grip portion with the fixed wall generally perpendicular the longitudinal axis of said grip portion, enabling the dispenser to be hand held, aimed, and actuated.

56. Apparatus defined in claim 55 wherein the product formulation and the discharge passageway configuration relative the momentum of the moving mass are such that the noodle dispensed from each discharge passageway substantially retains its integrity without any substantial breakup.

57. Apparatus defined in claim 56 wherein the product formulation, the momentum applied, and the size, distribution and number of the plurality of discharge passageways produce a generally uniformly moving cluster of generally uniformly defined and moving particles with minimal inhalables which may be aimed toward and spaced apart from a target surface so that the deposition pattern thereon may define a projection of the discharge passageway pattern.

58. Apparatus defined in claim 57 wherein the product formulation, the momentum applied, and the size, distribution and number of discharge passageways are such that the deposition pattern comprises a discrete projection of the individual discharge passageways.

59. Apparatus defined in claim 57 wherein the product formulation, the momentum applied, and the size, distribution and number of discharge passageways are such that the deposition pattern comprises a generally uniform coverage of the passageway locus set.

60. Apparatus defined in claim 57 wherein said energizing means comprises an energizing helve structurally associated with said container and configured to be hand held and actuated by a user's hand squeeze.

61. Apparatus defined in claim 60 wherein said energizing helve comprises a generally elongated hand grip portion, said trigger being pivotally mounted therewith such that inward rotation of said trigger by a user's hand squeeze around said grip portion actuates the dispenser and said container comprises a removable canister carried by an end portion of said helve opposite said grip portion with the fixed wall generally perpendicular the longitudinal axis of said grip portion, enabling the dispenser to be hand held, aimed, and actuated.

62. Apparatus defined in claim 61 wherein said canister comprises a generally annular wall extending generally perpendicular said fixed wall generally circumscribing said plurality of discharge passageways and defining a generally cylindrical bore and wherein said moveable wall comprises a relatively lightweight substantially rigid follower slidable therewithin.

63. Apparatus defined in claim 61 wherein the energy applied by the impact mass comprises not more than about 3 inch pounds.

64. A hand holdable, hand operable noncontact dispenser comprising a product canister with a plurality of generally open and unobstructed discharge passageways and a hand actuated energizing helve, said helve having associated therewith means for accelerating a movable impacting mass adapted for inducing a pressure pulse of very short time duration on a product within the canister, in combination with a stable, noncrusting, anhydrous, thixotropic antiperspirant cream product within said canister, said dispenser being adapted to provide metered and uniform noncontact spray applications thereof to axilla surfaces without, in general, imparting any undesirable, cold, wet or sticky sensation.

* * * * *

UNITED STATES PATENT OFFICE
CERTIFICATE OF CORRECTION

PATENT NO. : 4,167,245

DATED : Sept. 11, 1979

INVENTOR(S) : Ronald W. Kock; Theodore P. Merz; Paul K. Platt

It is certified that error appears in the above-identified patent and that said Letters Patent are hereby corrected as shown below:

Column 12, in the table, "1-1/3 in." on the first line under "Canister Diameter" should read —1-5/8 in.—.

Column 14, last line, "9%" should read —9°—.

Signed and Sealed this

*Eighth* Day of *January 1980*

[SEAL]

*Attest:*

SIDNEY A. DIAMOND

*Attesting Officer*

*Commissioner of Patents and Trademarks*